US008042463B2

(12) United States Patent
Sato

(10) Patent No.: US 8,042,463 B2
(45) Date of Patent: Oct. 25, 2011

(54) COATING DEVICE AND COATING UNIT IN A STENCIL PRINTING APPARATUS

(75) Inventor: Mitsuo Sato, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 673 days.

(21) Appl. No.: 12/170,827

(22) Filed: Jul. 10, 2008

(65) Prior Publication Data

US 2009/0025580 A1 Jan. 29, 2009

(30) Foreign Application Priority Data

Jul. 25, 2007 (JP) ..... 2007-193641

(51) Int. Cl.
*B41L 13/04* (2006.01)
*B41L 13/16* (2006.01)
*B41F 23/08* (2006.01)

(52) U.S. Cl. ..... 101/116; 101/119; 101/479; 101/424.2

(58) Field of Classification Search ..... 101/116, 101/118, 119, 120, 479, 480, 424.2
See application file for complete search history.

(56) References Cited

U.S. PATENT DOCUMENTS

| | | | | |
|---|---|---|---|---|
| 4,050,409 | A * | 9/1977 | Duchenaud et al. | 118/406 |
| 6,382,093 | B1 * | 5/2002 | Hara | 101/116 |
| 7,207,269 | B2 | 4/2007 | Yoshida | |
| 2007/0089623 | A1 | 4/2007 | Hamamoto et al. | |

FOREIGN PATENT DOCUMENTS

| | | |
|---|---|---|
| JP | 2003-266909 | 9/2003 |
| JP | 2003-312914 | 11/2003 |
| JP | 2004-313829 | 11/2004 |
| JP | 2006-35816 | 2/2006 |
| JP | 2006-76080 | 3/2006 |
| JP | 2006-281711 | 10/2006 |
| JP | 2007-111873 | 5/2007 |

* cited by examiner

*Primary Examiner* — Leslie J Evanisko
(74) *Attorney, Agent, or Firm* — Oblon, Spivak, McClelland, Maier & Neustadt, L.L.P.

(57) ABSTRACT

The invention discloses a varnish coating device that utilizes an ordinary conventional digital stencil printing apparatus, such that anyone can easily apply a uniform film of a viscous coating onto a predetermined area of, for instance, covers and surfaces of printed products. The invention functions as a varnish coating device, in place of a drum unit, when a varnish coating unit is mounted on a mounting section of a printing apparatus main body. The varnish coating unit has: a coating roller that coats the surface of printed paper with a transparent varnish liquid and feeds out the paper; a supply device having a doctor roller that forms a liquid pool on the coating roller and that supplies varnish liquid to form a coating in a predetermined thickness over a predetermined area of the surface of the coating roller; a cradle that detachably supports a varnish container; and a pumping device.

8 Claims, 11 Drawing Sheets

COATING DEVICE AND COATING UNIT IN A STENCIL PRINTING APPARATUS

BACKGROUND OF THE INVENTION

1. Field of the Invention

The present invention relates to a coating device and a coating unit in a stencil printing apparatus, and more particularly, to a coating device in a stencil printing apparatus in which the surface of a sheet printed using a stencil printing apparatus is coated with a viscous coating liquid such as a UV-curable varnish or the like, and to a coating unit that is mounted on a printing apparatus main body in place of a detachable printing drum unit.

2. Description of the Related Art

Known simple printing apparatuses include, for instance, digital heat-sensitive stencil printers (hereinafter, simply "stencil printing apparatuses") for digital heat-sensitive stencil printing. In such stencil printing apparatuses, a thermal head, having a plurality of small heat generators arranged in a main scanning direction, is brought into contact with a thermosensitive stencil master (hereinafter "master"), also called stencil paper, as the master is transported in a sub-scanning direction (master transport direction) that is perpendicular to the main scanning direction, while the heat generators are energized in pulses to thereby heat-melt punch the master in accordance with image information. The perforated master is wrapped around the outer peripheral face of a porous circular plate cylinder that is provided on the outer periphery of a printing drum, whereafter the outer peripheral face of the plate cylinder is pressed by a pressing means such as a press roller or the like, with printing paper (hereinafter also simply "paper"), as the medium to be printed, interposed therebetween. As a result, ink that is supplied to the inner peripheral face of the plate cylinder bleeds from the perforated portion of the plate cylinder and the perforated part of the master, whereupon the ink is transferred to the paper to yield a printed image. The printing drum is also referred to hereinafter as simply "drum".

The above stencil printing apparatuses, having low running costs and being operable at high speed, are extensively used for printing circulars, forms and the like in, for instance, the education market, but also in public offices, associations, hospitals and so forth, and for printing large runs of newspaper inserts, real estate advertisements, internal memos in private businesses and the like. That is because such inexpensive apparatuses enable easy printing by anyone at any time.

The printing paper used herein is ordinary paper or recycled paper, thus relatively inexpensive, the surface of which exhibits high ink penetration. This makes the images on the surface of the printed product look dull and drab. Also, the print image ink may dry apparently by penetrating into the fibers of the paper. Ordinarily, special fixing devices do not achieve complete fixing, and hence the resulting printed product is inferior from the viewpoint of storability, since rubbing thereof with the fingers may give rise to smears, while the printed product itself may become weakened if wet with water.

Known methods for imparting a stylish feel, as well as storability and abrasion resistance, to such printed products, include, for instance, lamination methods in which a transparent film is affixed to the surface of the printed product. Lamination, however, is time-consuming, and hence a low-productivity method, and is also problematic in that it requires a special device, called laminator, for heat fusion, and in that films are expensive.

Meanwhile, varnish coating devices are also known for imparting a stylish feel, as well as storability and abrasion resistance, to printed products. Varnish coating devices are dedicated devices for applying a transparent varnish on the surface of the printed product while the latter is being transported. Such devices are relatively bulky and expensive, and hence varnish coating was not something that could be done by anyone, readily and inexpensively.

Conventional varnish coaters are full-fledge coaters in which varnish is often applied over the entire surface of the printed product. These coaters are thus large equipment items that are used in printing establishments. Given that such equipment is large, expensive and requires trained personnel for its operation, no equipment has been known thus far that allows the user him/herself to coat with varnish an ordinary printed product, easily and quickly. Moreover, after coating the entire surface of the printed product with varnish, the periphery of the printed product is cut off. This requires an expensive dedicated paper cutter, which only printing establishments can afford.

Specifically, Japanese Patent Application Laid-open No. 2007-111873 (Prior Art 1) and 2006-76080 (Prior Art 2) disclose water-based varnish coating devices in large offset printing apparatuses.

Also, Japanese Patent Application Laid-open No. 2006-35816 (Prior Art 3) discloses a relatively small-size independent dedicated varnish coating device.

Japanese Patent Application Laid-open No. 2004-313829 (Prior Art 4) discloses a varnish coating device and a printer, in which a UV-curable varnish is sprayed, by liquid spraying nozzles, onto a specific area of printing paper, followed by curing through UV irradiation.

Since the above-described digital stencil printing apparatuses enable easy printing by anyone, inexpensively and by way of a simple operation, they are also widely used by free operators for printing relatively small runs. Japanese Patent Application Laid-open No. 2006-281711 (Prior Art 5) describes such a stencil printing apparatus, having a plurality of printing drum units that can be detachably mounted on the main body of the stencil printing apparatus, wherein a UV-radiating unit can be mounted in the place of a printing drum unit holding ordinary ink, when a printing drum unit holding a UV-curable ink is mounted upstream of a paper transport direction.

The water-based varnish coating devices disclosed in Prior Art 1 and Prior Art 2, however, are bulky and expensive, and hence not suitable for ordinary users. The varnish coating device of Prior Art 3 is relatively small, but is likewise expensive and unsuitable for ordinary users. Similarly, the varnish coating device of Prior Art 4 is costly and inappropriate for ordinary users.

Stencil printing apparatuses have involved heretofore mainly black printing on ordinary paper, plus occasional use for color printing in red or blue. The above-described drawbacks of inferior storability and poor aesthetics of the surface of printed products obtained in a stencil printing apparatus have become a stereotype, and hence the use of a stencil printing for varnish coating has been deemed unfeasible, or in other words, few considered the potential worth of using varnish coating.

SUMMARY OF THE INVENTION

In the light of the above, it is a main object of the present invention to realize and provide a coating device that uses an ordinary conventional digital stencil printing apparatus, such that the coating device allows anyone to easily apply a uniform film of a viscous coating onto a predetermined area of, for instance, covers and surfaces of printed products. In other words, an object of the present invention is to realize and provide a coating device and a coating unit that double as a stencil printing apparatus. In particular, it is an object of the present invention to provide a coating device and a coating unit having the function of applying a UV-curable varnish on the surface of a printed product.

In an aspect of the present invention, there is provided a coating device in a stencil printing apparatus in which printing drum unit whose outer peripheral face is wrapped with a prepared master can be detachably mounted on a printing apparatus main body. A coating unit that can be detachably mounted on the printing apparatus main body, in place of the printing drum unit, for forming a coating in a given thickness of a viscous coating liquid onto a predetermined area of a surface of a printed sheet that is fed.

In another aspect of the present invention, there is provided with a coating unit mounted on and detached from, in place of a printing drum unit whose outer peripheral face is wrapped with a prepared master, a printing apparatus main body of a stencil printing apparatus that can be detachably mounted on the printing apparatus main body. A coating is formed in a given thickness of a viscous coating liquid onto a predetermined area of a surface of a printed sheet. The coating unit comprises: a coating member for coating the surface of a printed sheet with a coating liquid; a supply device for forming a liquid pool, where the coating liquid accumulates temporarily, on the coating member, and for supplying the coating liquid to form a coating in a predetermined thickness to the surface of the coating member; a holding member for holding a coating liquid storage container that contains the coating liquid; and a pump device for feeding the coating liquid from the coating liquid storage container to the liquid pool.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT(S)

An embodiment of the present invention is explained next with reference to accompanying drawings.

Figure 1:
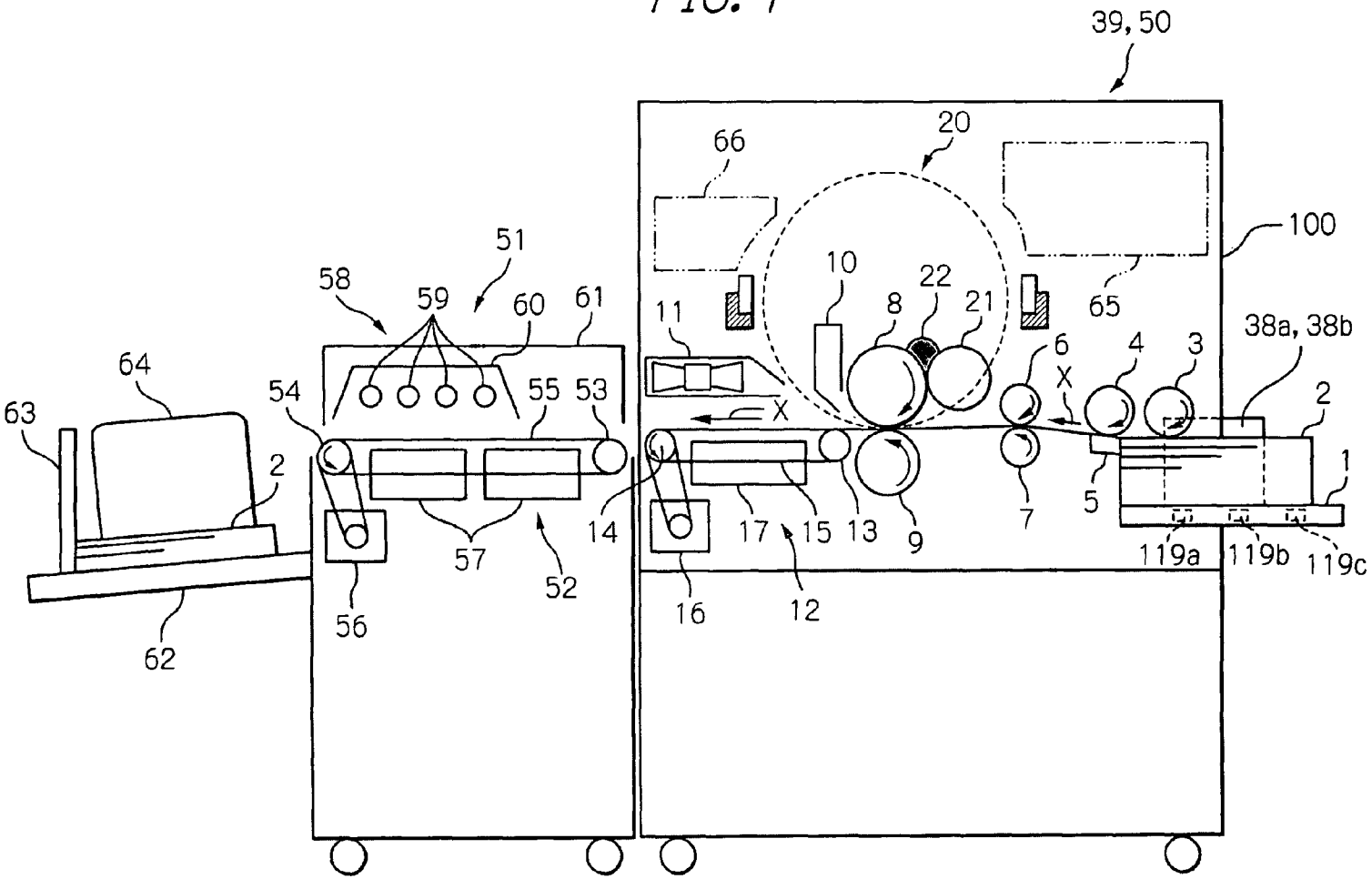
FIG. 1 is a front-view diagram illustrating schematically an entire printing apparatus according to an embodiment of the present invention, in which a UV-radiating device is connected to a varnish coating device.

With reference to FIG. 1, firstly there will be explained the overall constitution, and an outline of the operation, of a varnish coating device 39 as a coating device in a stencil printing apparatus 50 according to the embodiment. The figure depicts a varnish coating unit 20, comprised in the varnish coating device 39, attached to a mounting part of a printing apparatus main body 100, on the right of the figure.

In the overall apparatus illustrated in FIG. 1, the varnish coating device 39 (or the stencil printing apparatus 50) is connected to a UV-radiating device 51. The varnish coating device 39 in the stencil printing apparatus 50 comprises a pickup roller 3, a reverse roller 4 and a separation pad 5 for separating and paying out paper 2 already printed, as an already printed sheet-like printed product stacked on a paper-feeding tray 1, as a paper feed tray. In the trail (downstream) of the paper transport direction X, as the sheet transport direction, there are disposed an upper resist roller 6 and a lower resist roller 7 for feeding one separated sheet of the printed paper 2, with a predetermined timing, to a coating section at which the varnish coating unit 20 is mounted.

The paper-feeding tray 1, the pickup roller 3, the separation roller 4, the separation pad 5, the upper resist roller 6, the lower resist roller 7 and so forth make up a paper feeding section device or a paper feeding device, as a sheet feeding device.

In the coating section, the printed paper 2, fed at a predetermined timing by the upper resist roller 6 and the lower resist roller 7, is coated with a transparent UV-curable varnish (referred to hereinafter also as "varnish" or "varnish liquid"), as a viscous coating supply, by way of a coating roller 8, as a feeding coating member, which applies the transparent UV-curable varnish, to a predetermined thickness, onto the surface of the paper 2. The printed paper 2 is pressed against the coating roller 8 by a press roller 9, as a pressing member, whereby the surface of the printed paper 2 becomes coated with the varnish liquid.

An UV-curable varnish comprising, for instance, a monomer not using an organic solvent or the like as a raw material, a reaction initiator, a body pigment or the like is preferably used as the UV-curable varnish, from the viewpoint of handleability and superior environmental compatibility.

The printed paper 2, having thus been coated with varnish, is released from the coating roller 8 by air pressure from blown air coming from an air discharge fan 11, as an air release means, and an air separation pawl 10, as an air release means. The paper is then transported leftward in the figure by a paper output transport device 12. The paper output transport device 12 comprises a front roller 13, a back roller 14 and a plurality of endless belts 15 spanning therebetween, the back roller 14 being rotated by a driving motor 16, as a result of which the endless belts 15 are rotationally driven. The paper output transport device 12 comprises also a duct 17 with a built-in air suction fan, for suctioning the reverse face of the printed paper 2 and bringing the latter into contact with the endless belts 15. A below-described driving mechanism or the like (not shown) limits and controls the pressure range of the press roller 9 against the coating roller 8, in such a manner that no direct pressure is exerted on portions where there is no paper.

Figure 2:
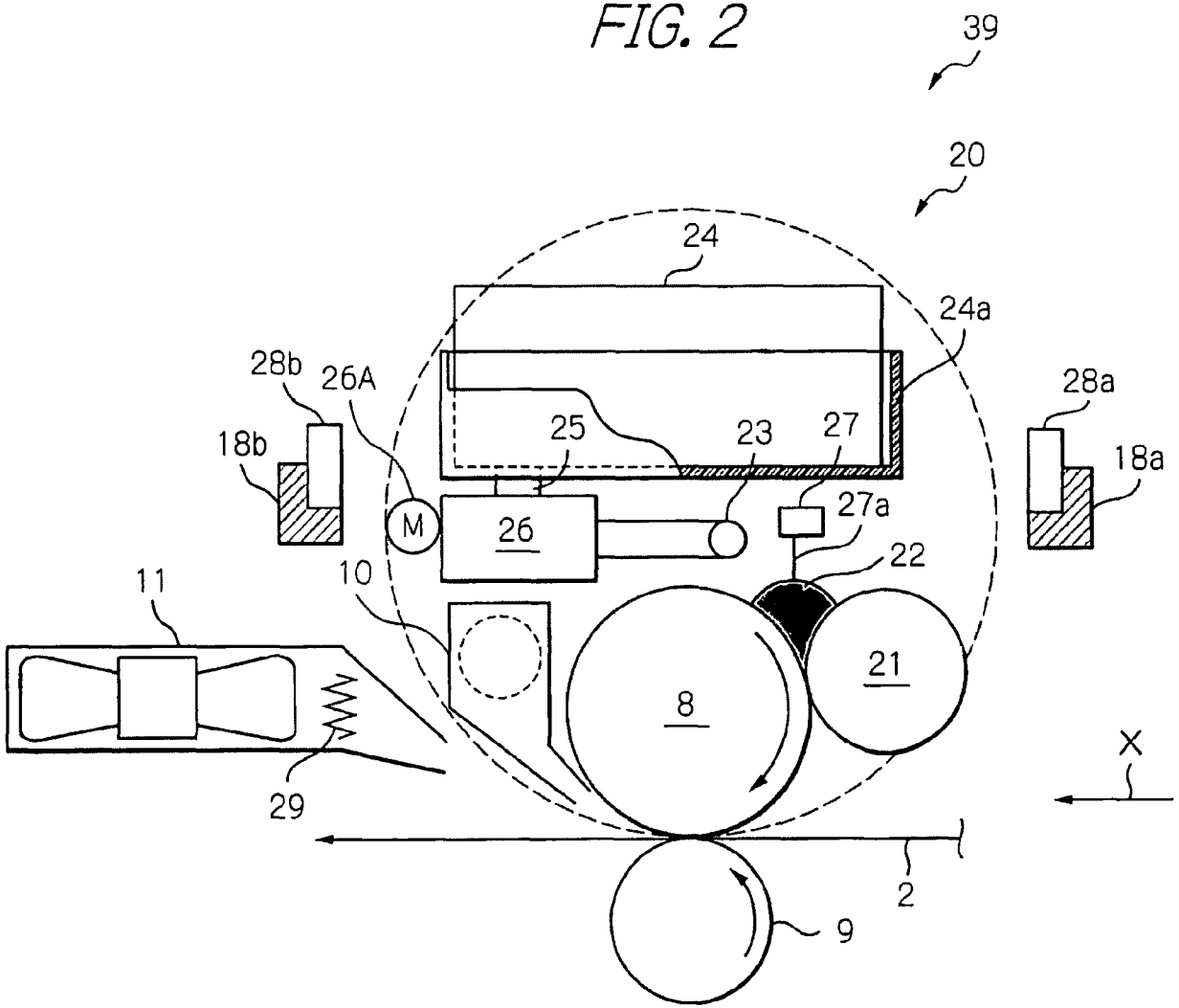
FIG. 2 is a partial cross-sectional diagram illustrating the configuration of a relevant portion of a varnish coating unit in the varnish coating device.

As illustrated in FIG. 2, the air blowing fan 11 is disposed, in the varnish coating unit 20, in the vicinity of the downstream side of the paper transport direction X at a printing nip section formed through pressing by the press roller 9. The air blowing fan 11 has a built-in heating coil heater 29 capable of turning into hot air the air that is blown for releasing and separating the printed paper 2 from the coating roller 8, once the printed paper 2 has been coated with varnish liquid.

In FIG. 1, the stencil printing apparatus 50 functions as the stencil printing apparatus 50 when a stencil printing drum unit 40 (hereinafter simply "drum unit 40") illustrated in FIG. 7, as a printing drum unit comprised in the stencil printing apparatus 50, is mounted/set on the mounting section of the printing apparatus main body 100.

The stencil printing apparatus 50 in FIG. 1 functions as the varnish coating device 39 when, instead of the drum unit 40, it is the varnish coating unit 20 that is mounted/set on the mounting section of the printing apparatus main body 100.

From the above it follows that the varnish coating device 39 in the stencil printing apparatus 50 refers basically to a varnish coating device 39 using a conventional stencil printing apparatus 50 for digital master making, in other words, a varnish coating device 39 that doubles as the stencil printing apparatus 50.

In FIG. 1, the reference numeral 65 denotes a portion of a plate feeder and a platemaking device for master making, that is equivalent to the platemaking section (3) illustrated in FIG. 1 and so forth of, for instance, Japanese Patent Application Laid-open No. 2003-266906. The reference numeral 66 denotes a plate discharging device for releasing/discharging a used master from a plate cylinder 70*a* of a printing drum 70 illustrated in FIG. 7, and which is equivalent to the plate discharging section (5) illustrated in FIG. 1 and so forth of, for instance, Japanese Patent Application Laid-open No. 2003-266906. When the varnish coating unit 20 is mounted, the platemaking device 65 and the plate discharging device 66 are controlled in such a way so as not to operate, as described below.

The UV-radiating device 51 comprises a printed product transport device 52 for transporting the printed paper 2, which is the received printed product. The printed product transport device 52 comprises a front roller 53, a back roller 54 and a plurality of perforated endless belts 55 spanning therebetween, the back roller 54 being rotated by a driving motor 56, as a result of which the perforated endless belts 55 are rotationally driven. The printed product transport device 52 comprises also a duct 57 with a built-in air suction fan, for suctioning the reverse face of the printed paper 2 and bringing the latter into contact with the perforated endless belts 55.

Above the printed product transport device 52 there is provided a UV-radiating unit 58 for irradiating UV rays onto the print image surface of the printed paper 2. The UV-radiating unit 58 comprises a plurality of UV-ray lamps 59, such as high-pressure mercury lamps, metal halide lamps or amalgam lamps, a reflective plate 60 formed by, for instance, an aluminum plate, and a cover casing 61 provided outward of the reflective plate 60.

The printed paper 2 transported by the printed product transport device 52 is irradiated with direct UV rays from the UV-ray lamps 59 and with UV rays reflected by the reflective plate 60. The surface varnish coated onto the printed paper 2 becomes cured and fixed thereby, after which the paper is stacked on a paper output tray 62, as a paper output tray.

In FIG. 1, the reference numeral 63 denotes an end fence against which the leading end of the outputted printed paper 2 collides, whereby the printed paper 2 becomes aligned in the paper transport direction X. The reference numeral 64 denotes a pair of right and left end fences for guiding and positioning the two side end faces of the outputted printed paper 2, i.e. for aligning the printed paper 2 in the paper width direction.

The constituent elements of the varnish coating unit 20 are explained next with reference to FIG. 2 and FIGS. 3A and 3B.

The varnish coating unit 20 is built to be detachably mountable on the above-described mounting section of the printing apparatus main body 100 illustrated in FIG. 1. The varnish coating unit 20 is mounted in the mounting section by removing therefrom the normally mounted drum unit 40 illustrated in FIG. 7. FIG. 2 is an enlarged view illustrating the varnish coating unit 20 mounted in the mounting section.

As partially explained above, the varnish coating unit 20 comprises, for instance, the coating roller 8, as a feeding coating member, which applies a transparent varnish liquid to the surface of the printed paper 2; a supply device for forming a liquid pool 22, where the varnish liquid accumulates temporarily, on the coating roller 8, and for supplying varnish liquid, to a predetermined thickness, over a predetermined area of the surface of the coating roller 8; a cradle 24A, as a holding member, for detachably holding a varnish container 24 as a coating liquid storing container for storing the varnish liquid; a pump device 26 for feeding varnish liquid from the varnish container 24 to the liquid pool 22; and a liquid supply pipe 23, connected to the pump device 26, for feeding varnish liquid to the liquid pool 22.

The coating roller 8 is rotatably pivoted and held by a rear unit chassis 30 and a front unit chassis 31, as stationary members comprised in the varnish coating unit 20. The coating roller 8 is rotationally driven in the direction of the arrow in the figure (clockwise direction) by a driving mechanism comprising a driving means, not shown. In terms of standardizing the main body constitution on the side of the stencil printing apparatus 50, such a driving mechanism comprises preferably couplings or the like, as driving force connection means, and driving force transmission means such as gears, belts or the like, not shown, for connecting and transmitting, for instance, the rotation driving force from a main motor, as a drum driving means, for rotationally driving the printing drum 70 illustrated in FIG. 7.

A doctor roller 21 is disposed in the vicinity of the coating roller 8, parallel thereto and with a predetermined gap between the doctor roller 21 and the coating roller 8. The liquid pool 22 forms on top of the coating roller 8 and the doctor roller 21. The doctor roller 21 pivots rotatably on the rear unit chassis 30 and the front unit chassis 31, in such a manner so as to be capable of rotating in the opposite direction of that of the coating roller 8. The varnish container 24, which stores a predetermined amount of varnish liquid and which can be detachably mounted on the cradle 24A of the varnish coating unit 20, is mounted/set on the cradle 24A provided in the varnish coating unit 20. The cradle 24A forms substantially a chassis shape with openings on the upper and lower portions thereof.

Figure 3A:
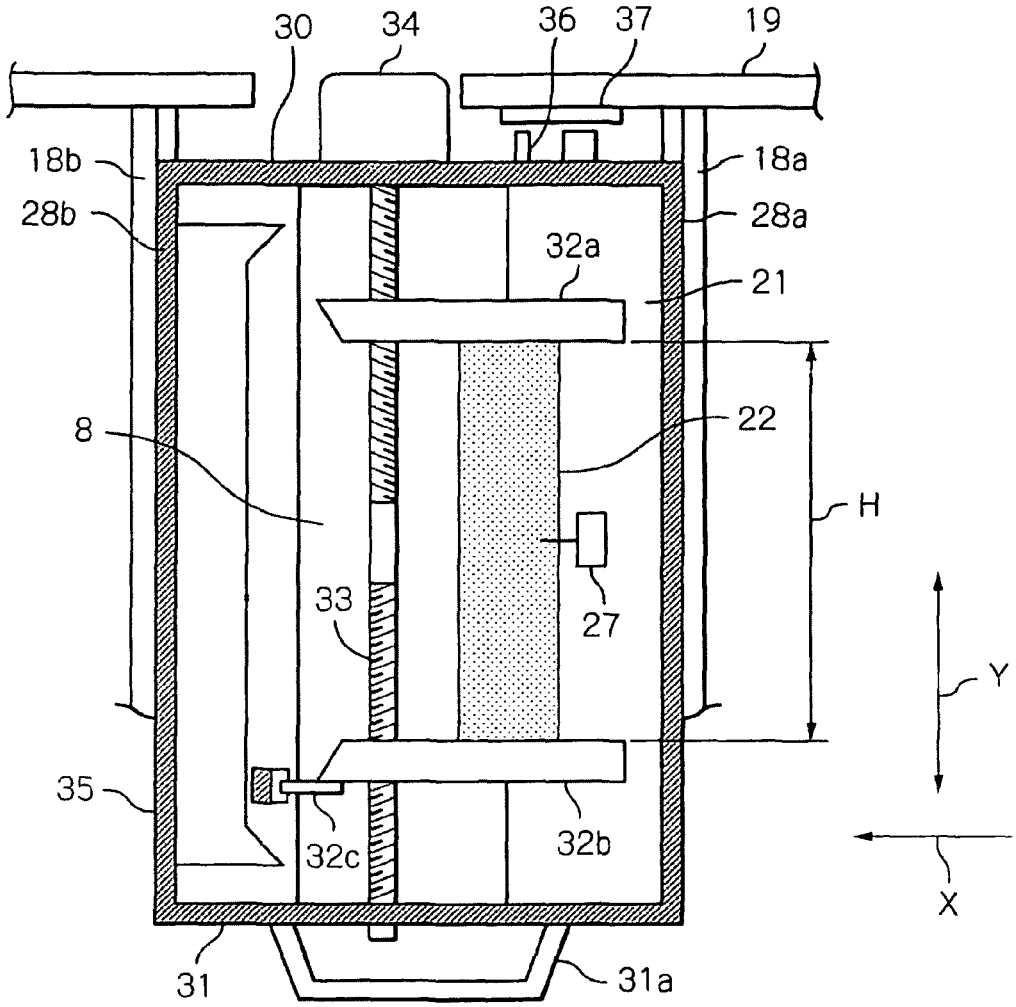
FIG. 3A is a partial plan-view cross-sectional diagram illustrating the constitution around a supply range varying means of the varnish coating unit in the varnish coating device.
Figure 3B:
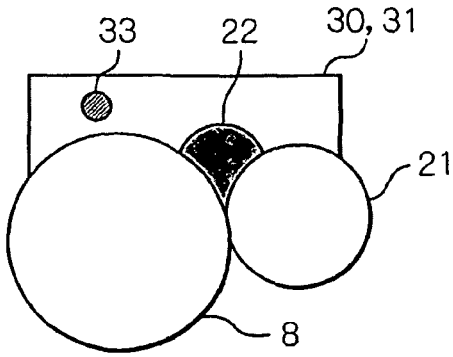
FIG. 3B is a cross-sectional diagram illustrating the constitution around the supply range varying means.

The supply device for forming a liquid pool 22, where the varnish liquid accumulates temporarily, on the coating roller 8, and for supplying varnish liquid, to a predetermined thickness, over a predetermined area of the surface of the coating roller 8, comprises mainly the doctor roller 21, as a coating liquid measuring member for supplying varnish liquid while measuring the varnish liquid in such a manner that the surface of the coating roller 8 carries a film of varnish liquid of a predetermined thickness, and the supply range varying means illustrated in FIGS. 3A and 3B.

The mechanism of the varnish feeding pump 26 may comprise a simple gear pump or a tube pump. The varnish feeding pump 26 may also be a reciprocating pump or the like. The varnish feeding pump 26 is driven by a pump motor 26A. Driven thus by the pump motor 26A, the varnish feeding pump 26 suctions varnish liquid through a cap 25 of the varnish liquid container 24, and transports the varnish liquid, via the liquid supply pipe 23, to supply the liquid pool 22.

Preferably, the coating roller 8 is shaped as a gravure roller having multiple small recesses on its surface. In that case, virtually no gap need be provided between the doctor roller 21 and the coating roller 8.

A liquid amount detecting sensor 27, comprising a liquid detection needle 27*a*, is disposed/set at the liquid pool 22. The liquid amount detection sensor 27 detects the size of the liquid pool 22, i.e. the amount of varnish liquid, on the basis of the same principle as an ink amount detection sensor 48 comprising an ink detection needle 48*a* illustrated in FIG. 7. When the liquid amount detection sensor 27 detects that the amount of varnish liquid in the liquid pool 22 has diminished, a controller 68 illustrated in FIG. 5 causes the varnish feeding pump 26 to be driven by turning on the pump motor 26A that drives the varnish feeding pump 26, such that when the liquid amount detection sensor 27 detects that the varnish liquid amount is sufficient, the controller 68 turns off the pump motor 26A so as to stop the varnish feeding pump 26.

The air separation pawl 10 separates and releases the printed paper 2 from the coating roller 8 by jetting downwards compressed air that is fed by a driving device not shown. The above various components, which are all comprised in the varnish coating unit 20, can be detachably mounted on the mounting section of the printing apparatus main body 100 together with the varnish coating unit 20.

Figure 7:
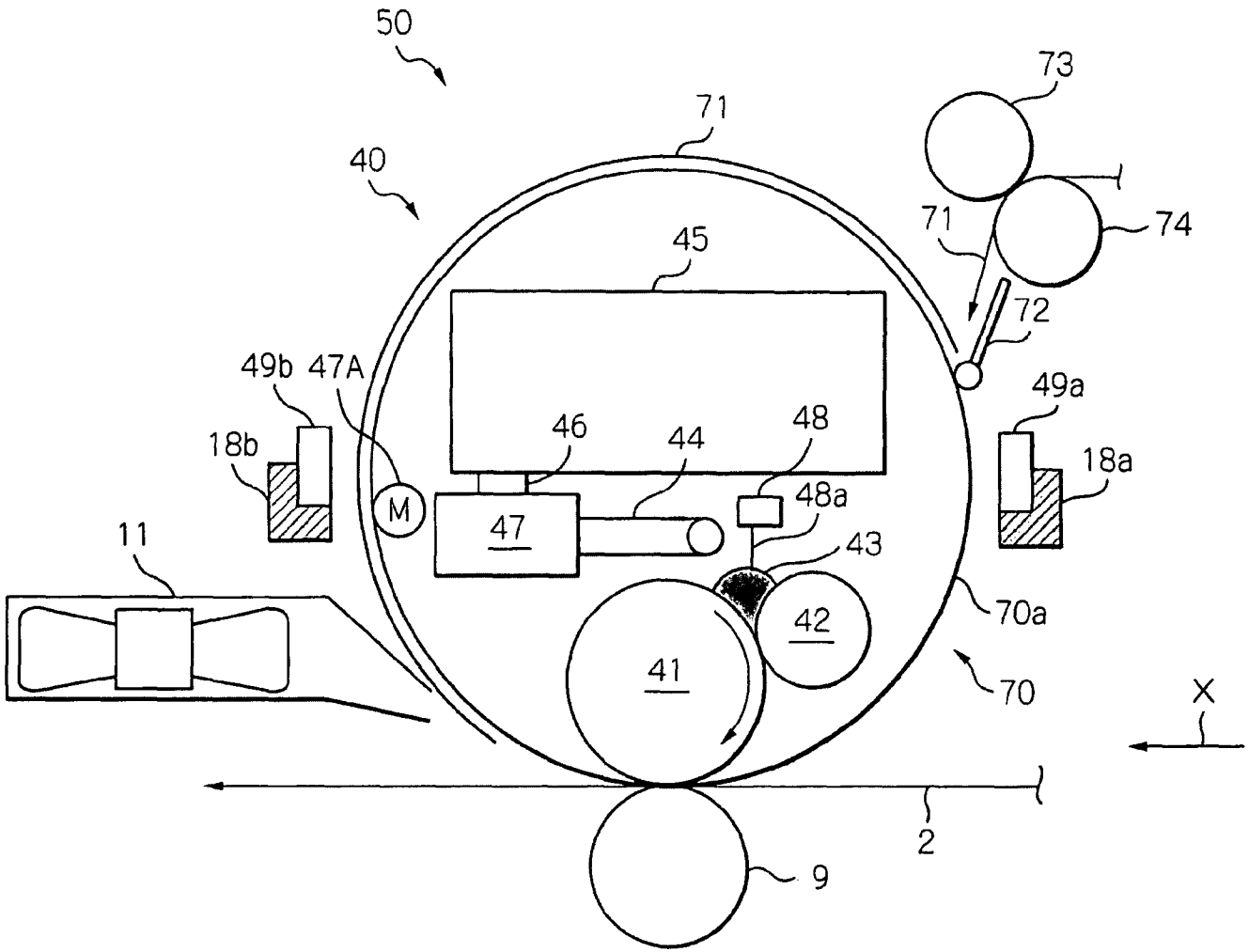
FIG. 7 is a partial cross-sectional diagram illustrating the configuration of a relevant portion of a drum unit in the stencil printing apparatus.

The broken-line circle in FIG. 1 and FIG. 2 denotes the size of the plate cylinder 70*a* when the drum unit 40 illustrated in FIG. 7 is mounted in the mounting section of the printing apparatus main body 100. In FIG. 2, the reference numerals 28*a*, 28*b* denote a pair of unit rails, provided as left and right guided members that double as a frame of the varnish coating unit 20. In FIG. 2, the reference numerals 18*a*, 18*b* denote a pair of guide rails, as guiding members, provided at the left and right of the printing apparatus main body 100, for slidably holding and guiding the unit rails 28*a*, 28*b*. The guide rails 18*a*, 18*b* and the unit rails 28*a*, 28*b* are formed extending from the front of the paper towards the back thereof, in FIG. 2.

The guide rails 18*a*, 18*b* and the unit rails 28*a*, 28*b* constitute the mounting/detachment means or insertion/detachment means that allow the varnish coating unit 20 to be detachably mounted on, or inserted into, the mounting section of the printing apparatus main body 100. The mounting section of the printing apparatus main body 100 refers to the site at which the varnish coating unit 20 is slidably set, along the guide rails 18*a*, 18*b*, extending from the front of the paper towards the back thereof, in FIG. 2, that is, the site at which the varnish coating unit 20 is connected, via couplings and so forth, with the driving system that rotationally drives the coating roller 8, and the site at which an electric connector, comprising terminals of the pump motor 26A, the liquid amount detection sensor 27 and so forth, on the side of the varnish coating unit 20, can lock with an electric connector provided on the side of the printing apparatus main body 100. The mounting section of the printing apparatus main body 100 refers also to the site at which a protrusion 36 illustrated in FIG. 3A comes close to and stands opposite a unit discrimination sensor 37, allowing thereby to discriminate and detect whether the mounted unit is the varnish coating unit 20 or the drum unit 40 illustrated in FIG. 7. In FIGS. 3A and 3B, the reference numeral 31*a* denotes a handle with which a user can mount/detach or insert/remove the varnish coating unit 20 into/from the mounting section of the printing apparatus main body 100.

The supply range varying means for modifying the varnish liquid supply length, as a coating liquid supply length in the paper width direction (sheet width direction) Y of the liquid pool 22 is explained next with reference to FIG. 3A and 3B. The supply range varying means comprises mainly two partition plates 32*a*, 32*b*, as partition members that can move in the paper width direction Y, for delimiting both ends of the liquid pool 22 in the paper width direction Y; a lead screw 33 as partition member moving means, for moving the partition plates 32*a*, 32*b* in a direction along which the latter are brought closer to or separated from each other by an equal amount; a stepping motor 34 as a driving means for rotationally driving the lead screw 33; and a home position sensor 35 as a partition member position detection means, for detecting the home position of the partition plate 32*b*.

The spacing between the respective ends of the partition plates 32*a*, 32*b* can be modified, through the rotation of the lead screw 33, in a direction along which the partition plates 32*a*, 32*b* are brought closer to or separated from each other by an equal amount. The lower end faces of the partition plates 32*a*, 32*b* are formed to a shape that allows the partition plates 32*a*, 32*b* to slide while in contact with the outer peripheral face of the upper half portions of the coating roller 8 and the doctor roller 21. The top faces of the partition plates 32*a*, 32*b* are guided by rail-shaped guiding members, not shown, fixed to the rear unit chassis 30 and the front unit chassis 31, as a result of which the partition plates 32*a*, 32*b* are supported so as to be movable only in the paper width direction, without change of the attitude of FIG. 3A. As described above, the varnish coating area length, as the varnish liquid supply length, is determined by the two partition plates 32*a*, 32*b*. In FIG. 3A, H denotes the varnish coating area length.

Although omitted in FIGS. 3A and 3B, varnish liquid is supplied to the liquid pool 22 from three sites of the liquid supply pipe 23 illustrated in FIG. 2. The lead screw 33 has threaded a left-hand screw and a right-hand screw in opposite directions, left and right, from the center of the lead screw 33, in such a manner that when the lead screw 33 rotates in one direction, the left-hand screw and the right-hand screw draw apart from each other by an equal amount, and when the lead screw 33 rotates in an opposite direction, the mutual distance between the left-hand screw and the right-hand screw narrows by an equal amount. A light shielding plate 32*c* that selectively engages with the home position sensor 35 is protrusively formed on the partition plate 32*b*. As illustrated in FIG. 3A, when the stepping motor 34 is driven by a predetermined pulse from the home position of the partition plates 32*a*, 32*b*, the lead screw 33 rotates in a predetermined direction by an extent corresponding to the predetermined pulse of the stepping motor 34. The partition plates 32*a*, 32*b* can thereby stop at an arbitrary position.

On a rear side plate 19 on the side of the printing apparatus main body 100 there is arranged the unit discrimination sensor 37 as a unit type detection means for detecting whether either the varnish coating unit 20 or the drum unit 40 illustrated in FIG. 7 is mounted on the mounting section of the printing apparatus main body 100. To carry out such detection, the unit discrimination sensor 37 comes close to, and stands opposite, the protrusion 36 provided at a specific position of the rear unit chassis 30. A concrete example of the unit discrimination sensor 37 that can be used may be, for instance, the combination of the hole element sensor group (20) and the magnets (30, 31, 32) disclosed in FIG. 3 and others in Japanese Patent Application Laid-open No. H08-132723 (paragraphs [0053]-[0054]), which allows discriminating whether the mounted unit is the varnish coating unit 20 or the drum unit 40 illustrated in FIG. 7. In the case of the drum unit 40, of course, the protrusion is provided at a position different from that of the varnish coating unit 20.

An operation panel 90 shared by the stencil printing apparatus 50 and the varnish coating unit 20 is explained next with reference to FIG. 4. In the control panel 90 there are arranged, for instance, mode selection keys 91*a*, 92*b*, a platemaking start key 92, a numerical keypad 93, a print start key (print start key) 94, and a liquid crystal display 95.

The mode selection key 91*a* functions as a mode selecting and setting means for selecting and setting a stencil printing mode, in which printing is carried out by mounting the drum unit 40 illustrated in FIG. 7 on the mounting section of the printing apparatus main body 100, while the mode selection key 91*b* functions as a mode selecting and setting means for selecting and setting a varnish coating mode, as a coating liquid application mode, in which varnish liquid is applied by mounting the varnish coating unit 20 on the mounting section of the printing apparatus main body 100.

The platemaking start key 92 functions as a start setting means for initiating a series of operations beginning with a platemaking operation, the print start key 94 functions as a printing start means for initiating a regular printing operation of a set number of printing sheets, and the numerical keyboard 93 functions as a register setting means for registering, for instance, the number of print sheets. The liquid crystal display 95, like for instance the liquid crystal (64) illustrated in FIG. 2 of Japanese Patent Application Laid-open No. 2006-281658, displays various settings and/or detection status, as needed, on the basis of a hierarchic display structure.

The configuration of a main control system of the varnish coating device 39 and the stencil printing apparatus 50 is succinctly explained next with reference to FIG. 5.

In the figure, the controller 68 comprises a microcomputer in which, for instance, a CPU (central processing unit), an I/O (input/output) port, a ROM (reading only memory), a RAM (random access memory), a timer and so forth, none of which are shown, are connected by way of a signal bus, not shown. The controller 68 is provided at a control board arrangement section in the printing apparatus main body 100.

The CPU of the controller 68 (hereinafter referred to simply as the "controller 68", for the sake of simplicity) has the function of controlling the various motors and so forth, as well as controlling the driving means of a platemaking and plate feeding driving circuit 67, such as the platemaking device 65. The CPU of the controller 68 has also the function of controlling a document reading operation, the plate discharge operation, the paper feeding operation, as well as of controlling the liquid crystal display 95 of the operation panel 90, on the basis of, for instance, various signals from the control panel 90, detection signals from the various above-described and below-described sensors provided in the varnish coating device 39 and the stencil printing apparatus 50, and on the basis of operation programs, relational data and the like, called from the ROM. In the present embodiment, moreover, the CPU of the controller 68 functions as a control means for carrying out the below-described distinctive control.

The operation programs, necessary relational data and the like for the entire stencil printing apparatus 50 and varnish coating device 39 are stored beforehand in the ROM. The operation programs can be arbitrarily called by the CPU. The RAM has, for instance, the function of temporarily storing computation results of the CPU, and of storing, on demand, on/off signals and data signals that are set and inputted by the various sensors and the various keys on the operation panel 90.

The controller 68 functions as a first through eighth control means that perform the below-described controls while referring to operation programs and so forth called from the ROM.

Figure 6B:
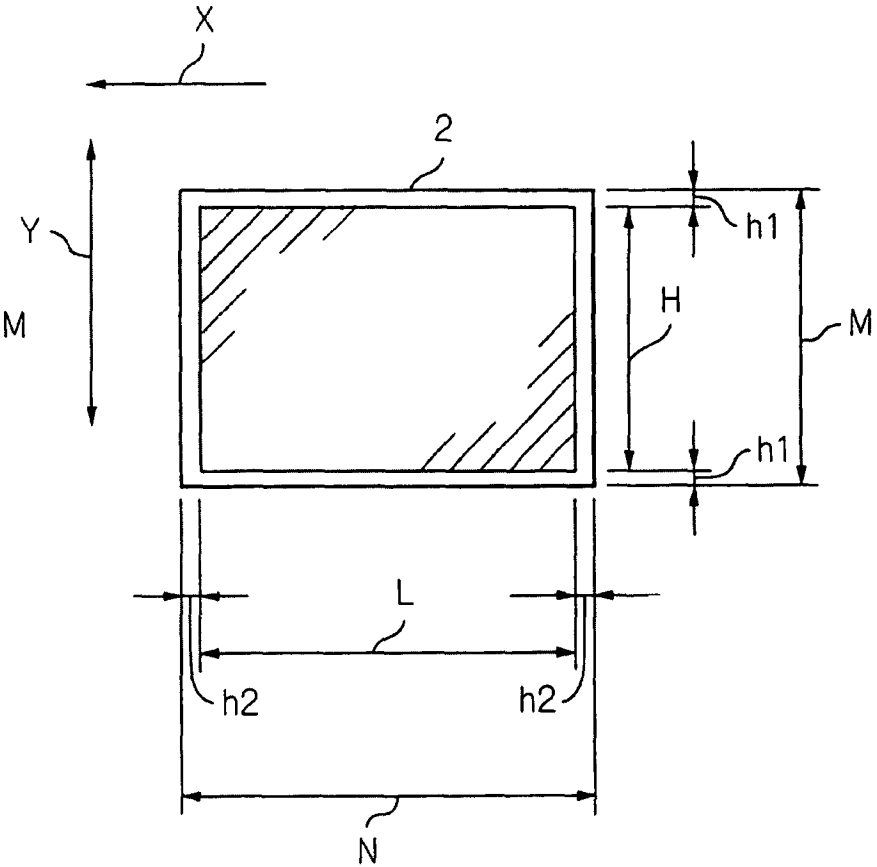
FIGS. 6A and 6B are diagrams for explaining detection of the dimensions, as well as margins, varnish coating area length and so forth in printed paper, on a paper-feeding tray of the varnish coating unit of the stencil printing apparatus in FIG. 1.
Figure 6A:
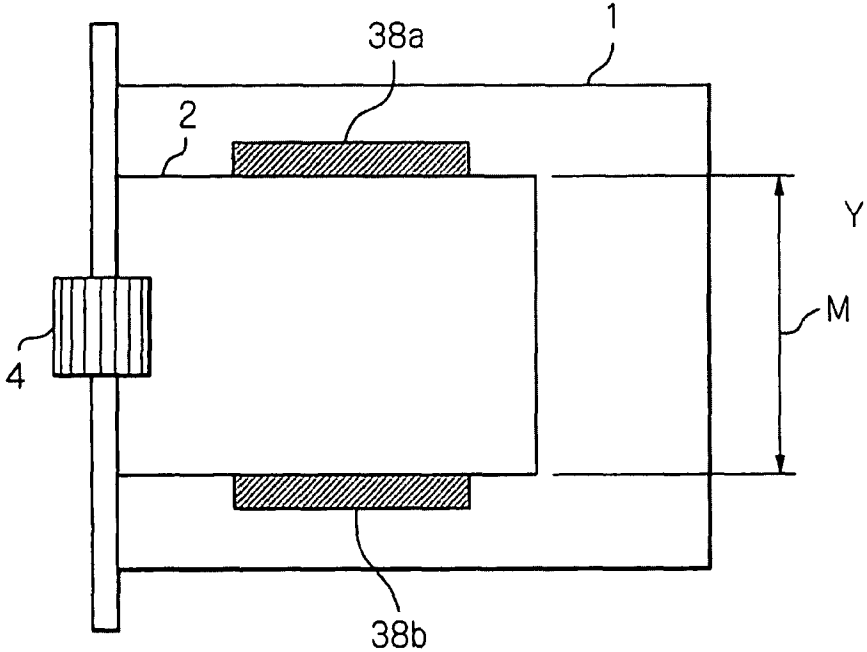

A supplementary explanation follows next, with reference to FIG. 1 and FIGS. 6A and 6B, on the sheet width size detection means and the sheet transport direction size detection means shared by the varnish coating device 39 and the stencil printing apparatus 50. The paper width direction size and the paper transport direction size of the printed paper 2 or unprinted paper 2 (hereinafter referred to simply as "paper 2" when the difference therebetween is evident) stacked/set on the paper-feeding tray 1, as a paper feed tray, are detected using well-known means. In FIG. 1, and FIGS. 6A and 6B, specifically, the width direction dimension M of the paper 2 is detected based on the position of a pair of left and right paper feeding side fences 38*a*, 38*b* capable of moving close to or away from each other, by an equal amount, in the paper width direction Y.

As specific examples of the sheet width size detection means and sheet transport direction size means there can be used, for instance, means similar to the paper size detection sensors (117) of the paper size detection means (109) (horizontal size detection sensors (118*a*, 118*b*) and vertical size detection sensors (119*a*, 119*b*, 119*c*)) described in paragraphs [0122] to [0125] and illustrated in FIG. 11 of Japanese Patent Application Laid-open No. 2003-312914. That is, the paper width detection sensors 118*a*, 118*b* in FIG. 5 of the present embodiment are identical to the horizontal size detection sensors (118*a*, 118*b*), while the paper length detection sensors 119*a* through 119*c* in FIG. 5 and FIG. 1 of the present embodiment are identical to the vertical size detection sensors (119*a*, 119*b*, 119*c*).

With reference to FIG. 7, an explanation follows next on the constitution of the relevant portions of the stencil printing apparatus 50, and on an outline of the operation thereof, when the drum unit 40 is mounted on the mounting section of the printing apparatus main body 100 illustrated in FIG. 1, in place of the varnish coating unit 20. As described above, the drum unit 40 can be detachably mounted on the mounting section of the printing apparatus main body 100.

The drum unit 40 comprises mainly an ink roller 41, as an ink supply member, for supplying ink to the inner peripheral face of the plate cylinder 70*a*; a doctor roller 42 disposed parallelly to the ink roller 41, with a predetermined gap therebetween, for forming an ink pool 43 between the ink roller 41 and the doctor roller 42; a cradle (not shown) into which there is detachably mounted an ink container 45, as an ink storage container for storing a predetermined amount of ink; an ink feeding pump 47 for feeding ink from the ink container 45 to the ink pool 43; and an ink supply pipe 44 connected to the ink feeding pump 47, for supplying ink to the ink pool 43.

The ink roller 41 is rotatably pivoted and held by a unit side plate (not shown), which is a stationary member comprised in the drum unit 40, and is rotationally driven in the arrow direction of the figure (clockwise direction). Such a driving mechanism comprises preferably couplings or the like, as driving force connection means and driving force transmission means such as gears, belts or the like, not shown, for connecting and transmitting, for instance, the rotation driving force from a main motor as a drum driving means for rotationally driving the printing drum 70. The doctor roller 42 is supported on the ink side plate in such a way so as to be rotatable in a direction opposite to that of the ink roller 41. The doctor roller 42 functions as an ink measuring member for supplying ink by measuring a predetermined thickness of film-like ink carried on the surface of the ink roller 41.

The ink container 45, which stores a predetermined amount of ink, is detachably mounted/set on the above-described cradle of the drum unit 40. The mechanism of the ink feeding pump 47 may comprise a simple gear pump. The feeding pump 47 may also be a reciprocating pump or the like. The ink feeding pump 47 is driven by an ink pump motor 47A. Driven thus by the ink pump motor 47A, the ink feeding pump 47 suctions ink through a cap 46 of the ink container 45, and transports the ink, via the ink supply pipe 44, to supply the ink pool 43.

An ink amount detecting sensor 48, comprising an ink detection needle 48*a*, is disposed/set at the ink pool 43. The ink amount detection sensor 48 comprising the ink detection needle 48*a*, is a well-known sensor that detects the size of the ink pool 43, namely the quantity of ink, for instance on the basis of capacitance. When the ink amount detection sensor 48 detects that the amount of ink has diminished, the controller 68 illustrated in FIG. 5 causes the ink feeding pump 47 to be driven by turning on the ink pump motor 47A that drives the ink feeding pump 47. When the ink amount detection sensor 48 detects that the ink amount is sufficient, the controller 68 turns off the ink pump motor 47A so as to stop the ink feeding pump 47.

The above various components, which are all comprised in the drum unit 40, can be detachably mounted on the mounting section of the printing apparatus main body 100 together with the drum unit 40.

In FIG. 7, the reference numerals 49*a*, 49*b* denote a pair of unit rails, provided as left and right guided members that double as a frame of the drum unit 40. The unit rails 49*a*, 49*b* are formed extending from the front of the paper towards the back thereof, in FIG. 7. The unit rails 49*a*, 49*b* are held and guided by guide rails 18*a*, 18*b*, on the main body side, identical to those illustrated in FIG. 2.

The guide rails 18*a*, 18*b* and the unit rails 49*a*, 49*b* make up a mounting/detachment means or an insertion/detachment means that allows the varnish drum unit 40 to be detachably mounted on, or inserted into, the mounting section of the printing apparatus main body 100. The mounting section of the printing apparatus main body 100 refers to the site at which the drum unit 40 is slidably set, along the guide rails 18*a*, 18*b*, extending from the front of the paper towards the back thereof, in FIG. 7, that is, the site at which the drum unit 40 is connected, via couplings and so forth, with the driving system that rotationally drives the ink roller 41 and the printing drum 70 having the plate cylinder 70*a* on the outer periphery thereof, and the site at which an electric connector, comprising terminals of the ink pump motor 47A, the ink amount detection sensor 48 and so forth of the drum unit 40 can lock with an electric connector provided on the side of the printing apparatus main body 100. The mounting section of the printing apparatus main body 100 refers also to the site at which the protrusion 36 illustrated in FIG. 3A comes close to and stands opposite the unit discrimination sensor 37, allowing thereby to discriminate and detect whether the mounted unit is the drum unit 40 or the varnish coating unit 20 illustrated in FIGS. 1 and 2.

A prepared master 71 is wrapped around the outer periphery of the cylindrical plate cylinder 70*a*. A master damper 72 for holding a leading end of the prepared master 71 is openably and closably mounted on one generatrix of the outer periphery of the plate cylinder 70*a*. When the printing drum 70 occupies a plate feeding position, for temporarily clamping the prepared master 71 fed by the platemaking device 65 illustrated in FIG. 1, and a plate discharge position at which the plate discharging device 66 illustrated in FIG. 1 releases and discharges the used master 71 from the plate cylinder 70*a*, the master damper 72 is opened and closed by an opening and closing device, not shown, disposed on the side of the printing apparatus main body 100. The prepared master 71 is transported towards the master damper 72, expanded into a plate feeding standby state, by way of an upper plate feeding 73 and a lower plate feeding roller 74 arranged most downstream in the master transport direction of the platemaking device 65.

A pressing force varying means 96 and a pressure range varying means, which constitute the pressure mechanism of the press roller 9, are explained next with reference to FIGS. 8A and 8B.

Figure 8A:
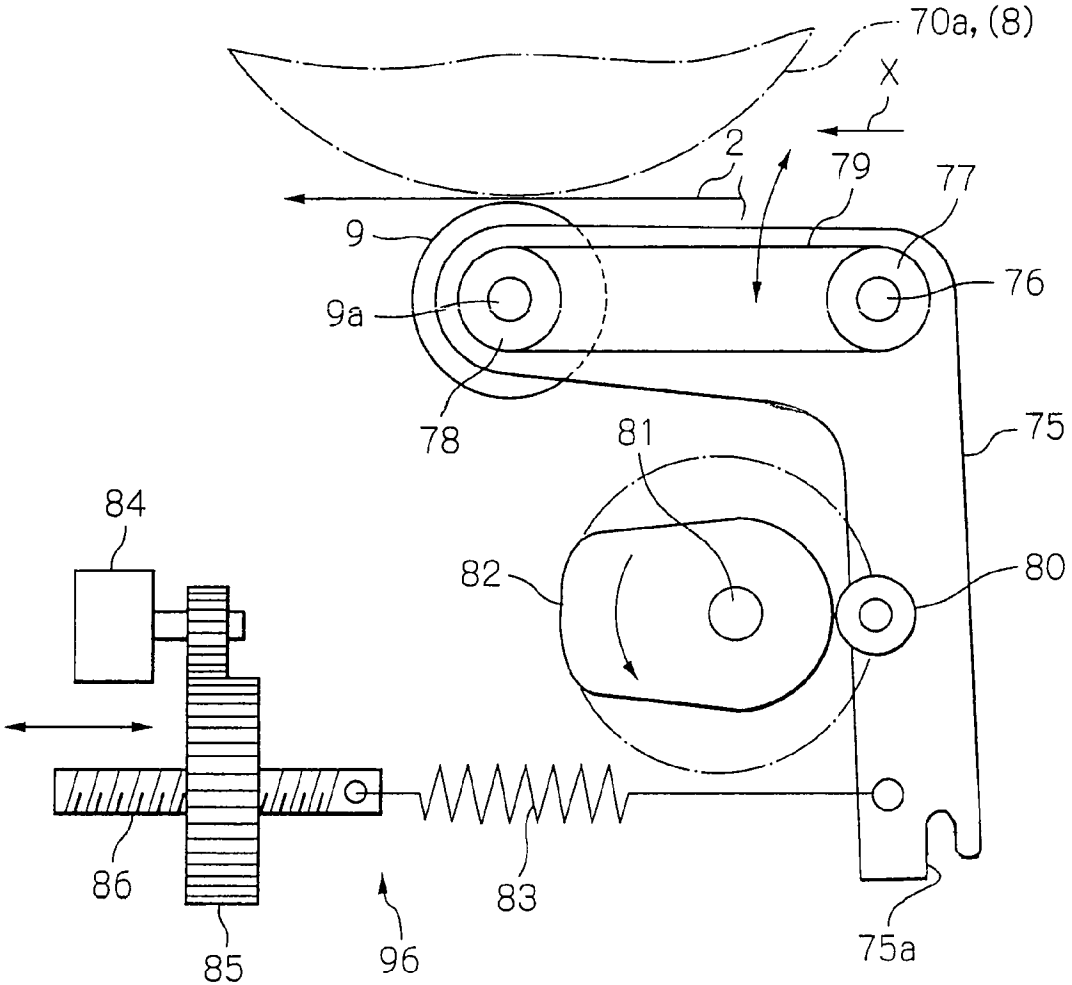
FIG. 8A is a front-view diagram illustrating a first configuration of a pressure range varying means and a pressing force varying means as a pressure mechanism of a press roller.

As shown in FIG. 8A, the press roller 9 is rotatably supported by way of a shaft 9*a* on an end of an L-shaped pressure arm 75. On the bent portion that forms the L-shape of the pressure arm 75 there is fixed a shaft 76 supported on the printing apparatus main body 100 so as to be able to pivot within a predetermined angle range. The pressure arm 75 is supported so as to be capable of swinging around the shaft 76 in the two directions of the arrow in the figure. The rotational driving force of the above-described main motor is imparted to the press roller 9 by way of a timing belt 79 spanning between a timing pulley 77 rotatably supported on the shaft 76 and a timing pulley 78 rotatably supported on the shaft 9*a*. Specifically, the timing pulley 77 is a two-step pulley in which there is spanned a timing belt (not shown), different from the timing belt 79, for transmitting the rotational driving force of the main motor.

In FIG. 8A, the reference numeral 80 denotes a cam follower ball bearing swingably provided in the pressure arm 75, the reference numeral 82 denotes a pressure relief cam provided opposite the cam follower ball bearing 80, and capable of rotating around a selectively engageable camshaft 81. The reference numeral 83 denotes a tension spring, for imparting pressing force to the press roller 9. One end of the tension spring 83 is latched to the pressure arm 75, the other end being latched to a lead screw 86 that can move along the paper transport direction X. The pressure relief cam 82 comprises, on the contour peripheral face thereof, a large-diameter portion and a small-diameter portion of predetermined respective extents. Pressure against the coating roller 8 or the plate cylinder 70*a* is turned off when the large-diameter portion engages with the cam follower ball bearing 80. Pressure against the coating roller 8 or the plate cylinder 70*a*, through the urging force of the tension spring 83, is turned on when the small-diameter portion faces the cam follower ball bearing 80 with a gap therebetween (cam is not engaged). In other words, pressure can be turned off/relieved, within a predetermined range, through engaging and disengaging of the pressure relief cam 82 and the cam follower ball bearing 80.

The pressing force varying means 96 is a mechanism for changing the pressing force with which the press roller 9 presses the printed paper 2 against the plate cylinder 70*a* or the coating roller 8. The pressing force varying means 96 comprises mainly the above tension spring 83; a pressing force varying motor 84 fixed to the printing apparatus main body 100; a gearwheel 85 swingably supported on the printing apparatus main body 100, and having a female thread in the center, for screwing onto the lead screw 86; and the lead screw 86, onto which the female thread of the gearwheel 85 is screwed, and capable of moving only in the paper transport direction X.

The pressing force with which the press roller 9 presses the printed paper 2 against the plate cylinder 70*a* or the coating roller 8 is modified through the displacement of the lead screw 86, in the arrow direction in the figure, on account of the rotation of the gearwheel 85 driven by the pressing force varying motor 84.

When the drum unit 40 is mounted, pressure is turned on, within a pre-defined range, by the pressure relief cam 82. The pressing force required herein is substantial, of 147 to 196 N (15 to 20 kgf), for which reason such a cam mechanism is used.

When the varnish coating unit 20 is mounted, on the other hand, the varnish liquid can be applied with a smaller pressing force than in stencil printing. Specifically, a pressing force of about 49 to 98 N (5 to 10 kgf) is sufficient for varnish liquid application. Therefore, the pressing force varying motor 84 is driven to shorten the length of the tension spring 83 vis-à-vis the length during stencil printing. The pressure force is changed thereby to a lower value, and use of the pressure relief mechanism by the pressure relief cam 82 is avoided. That can be achieved by turning off the rotation of the pressure relief cam 82 by way of, for instance, an electromagnetic clutch mechanism. To that effect there can be used known methods such as those described above, and hence a detailed explanation thereof is omitted.

Figure 8B:
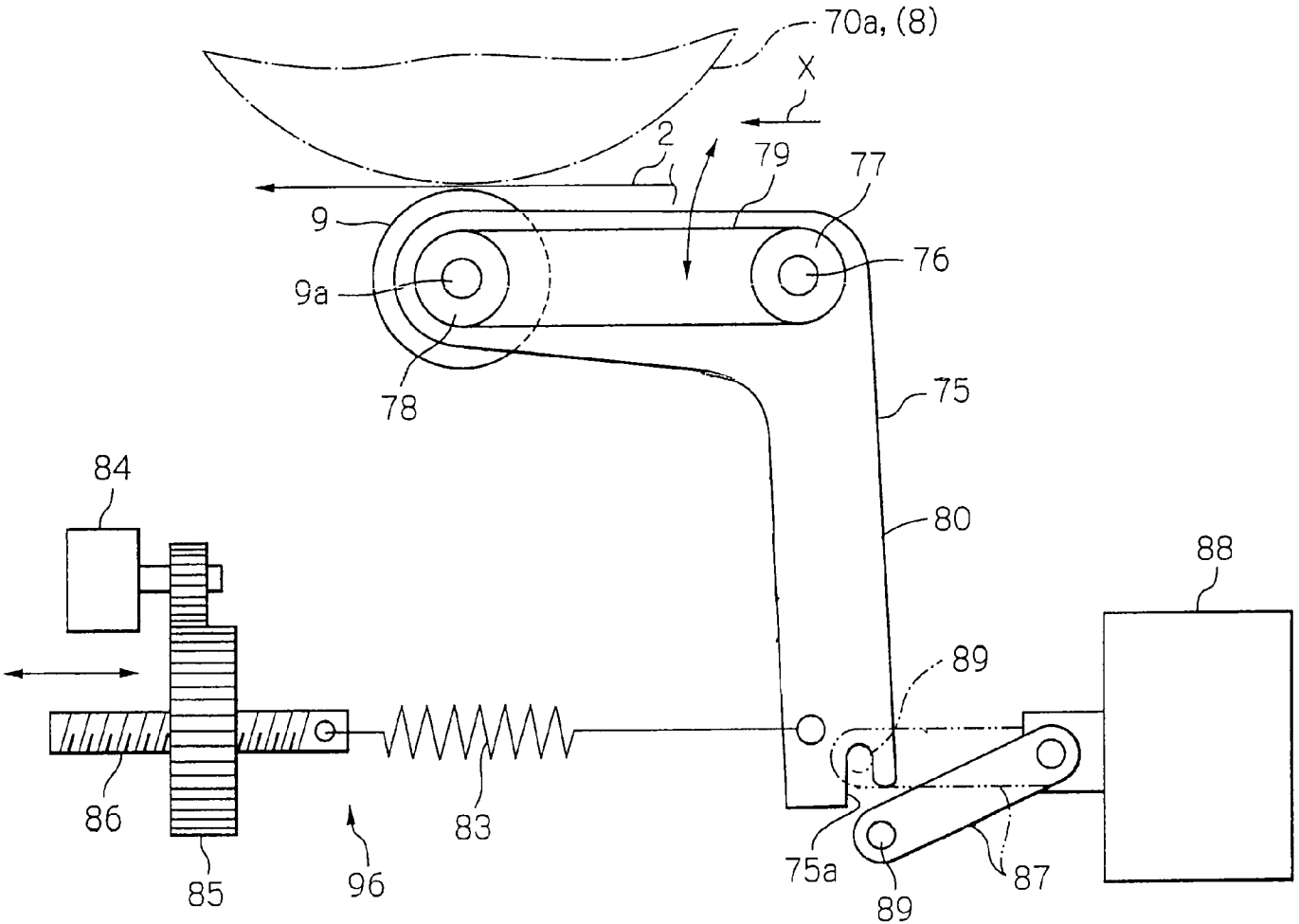
FIG. 8B is a front-view diagram illustrating a second configuration of a pressure range varying means and a pressing force varying means as a pressure mechanism of a press roller.

Instead of using a pressure relief mechanism, pressure is relieved in FIG. 8B through coupling of a solenoid 88 to the other end portion of the pressure arm 75, via a coupling of an intermediate link 87 having a pin 89 on the leading end thereof. That is, coupling is effected through fitting of the pin 89 of the intermediate link 87 into a cutout groove 75*a* that is formed on the other end portion of the pressure arm 75. By way of a mechanism not shown, the pin 89 of the intermediate link 87 hooks into the cutout groove 75*a* of the pressure arm 75, coupling thereby the intermediate link 87 to the pressure arm 75, whereupon the solenoid 88 is turned on, and pressure is relieved as a result. (The mechanism not shown may be such that, when the drum unit 40 is mounted, a tension spring not shown that positions the free end of the intermediate link 87 at a position represented by a solid line in FIG. 8B, and such that, when the varnish coating unit 20 is mounted, a solenoid other than the solenoid 88 positions the free end of the intermediate link 87 at a position represented by a broken line in FIG. 8B.) In this case, the pressing force (printing-pressure pressing force) becomes small, of about 49 to 98 N, and can hence be relieved by the solenoid 88.

This method allows turning the pressure on and off within an arbitrary range. As a result, the press roller 9 can be pressed against the coating roller 8 within an optimal pressure range in accordance with the paper size (paper length) in the paper transport direction, detected by the paper length detection sensors 119*a* through 119*c*. Control may be carried out herein in such a manner that the pressure is turned on within the range corresponding to the varnish coating area L illustrated in FIG. 10.

Figure 9:
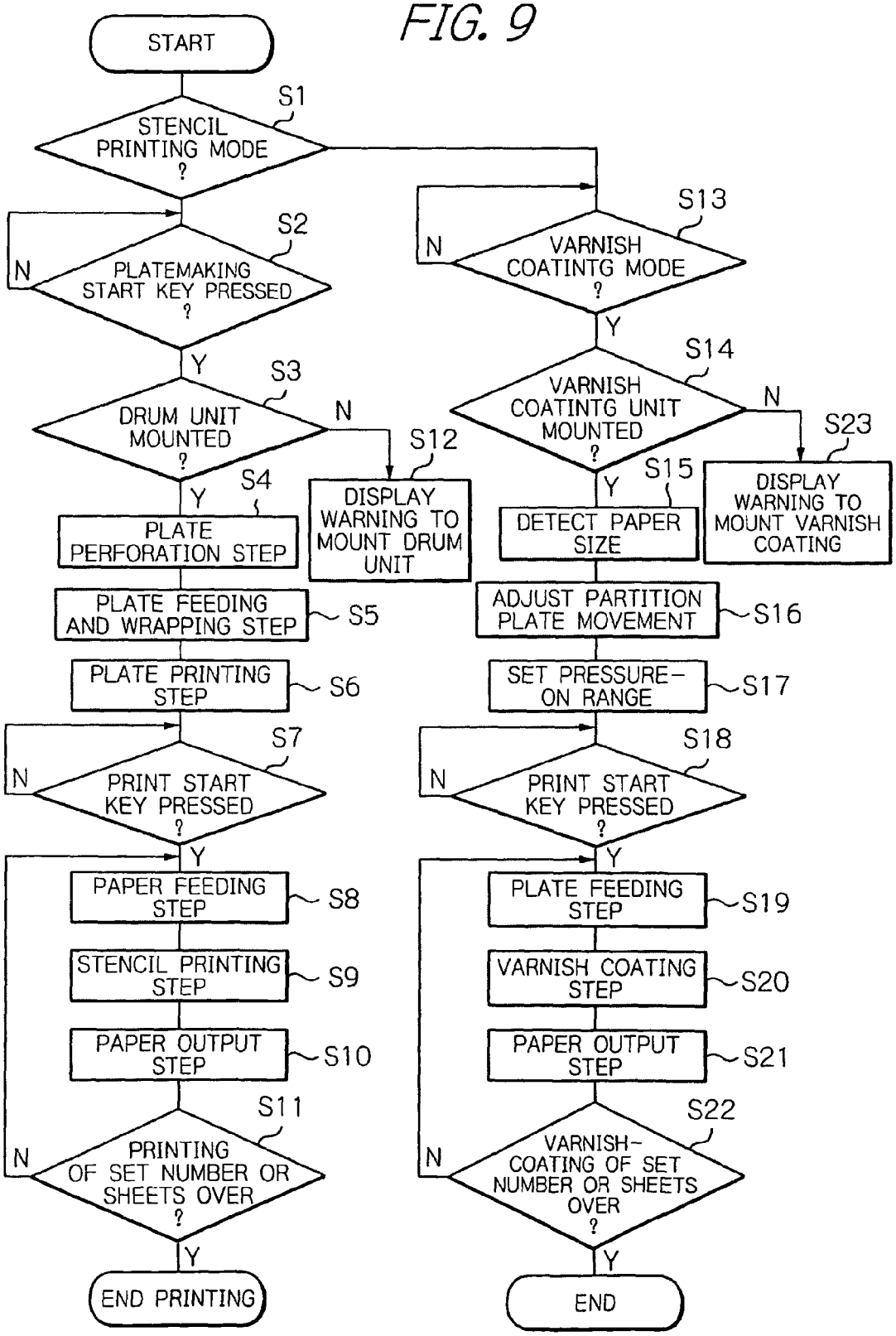
FIG. 9 is a flowchart for explaining an overall operation sequence and so forth of the varnish coating unit in a stencil printing apparatus.

An explanation follows next on the operation control flow of the varnish coating device 39 in the stencil printing apparatus 50 of the present embodiment, on the basis of the flowchart of FIG. 9 and while referring to FIGS. 1 through 8 and FIG. 10. This operation control flow is executed under the control of the CPU of the controller 68 illustrated in FIG. 5 (hereinafter, simply "controller 68").

In step S1, there is firstly checked whether the mode is a stencil printing mode. Specifically, when the user presses the mode selection key 91*a* in FIG. 4, he or she can visually check that the stencil printing mode is set as indicated by the lit-up LED (light-emitting diode) for stencil printing mode setting, arranged next to the mode selection key 91*a* on the left thereof. When the user presses the mode selection key 91*b*, he or she can visually check that the varnish coating mode is set as indicated by the lit-up LED (light-emitting diode) for varnish coating mode setting, arranged to the mode selection key 91*b* on the left thereof.

When the LED (light-emitting diode) for stencil printing mode setting is lit up, indicating that the stencil printing mode is set, it is checked whether the platemaking start key 92 is pressed or not. If the platemaking start key 92 is pressed, it is checked whether or not the drum unit 40 is mounted on the mounting section of the printing apparatus main body 100, when the series of stencil printing operations reach the start setting state,(step S2, step S3).

On the other hand, when the LED (light-emitting diode) for varnish coating mode setting is lit up, indicating that the varnish coating mode is set, it is checked whether or not the varnish coating unit 20 is mounted on the mounting section of the printing apparatus main body 100 (step S12, step S13).

In step S3 and step S13, the controller 68 functions as a seventh control means. Specifically, the controller 68 performs control so as to permit the inputs and operations for executing the stencil printing mode when the stencil printing mode is selected and set, through pressing of the mode selection key 91*a*, and the unit discrimination sensor 37 detects that the drum unit 40 is mounted, and so as to permit the inputs and operations for executing the varnish coating mode when the varnish coating mode is selected and set, through pressing of the mode selection key 91*b*, and the unit discrimination sensor 37 detects that the varnish coating unit 20 is mounted.

Figure 4:
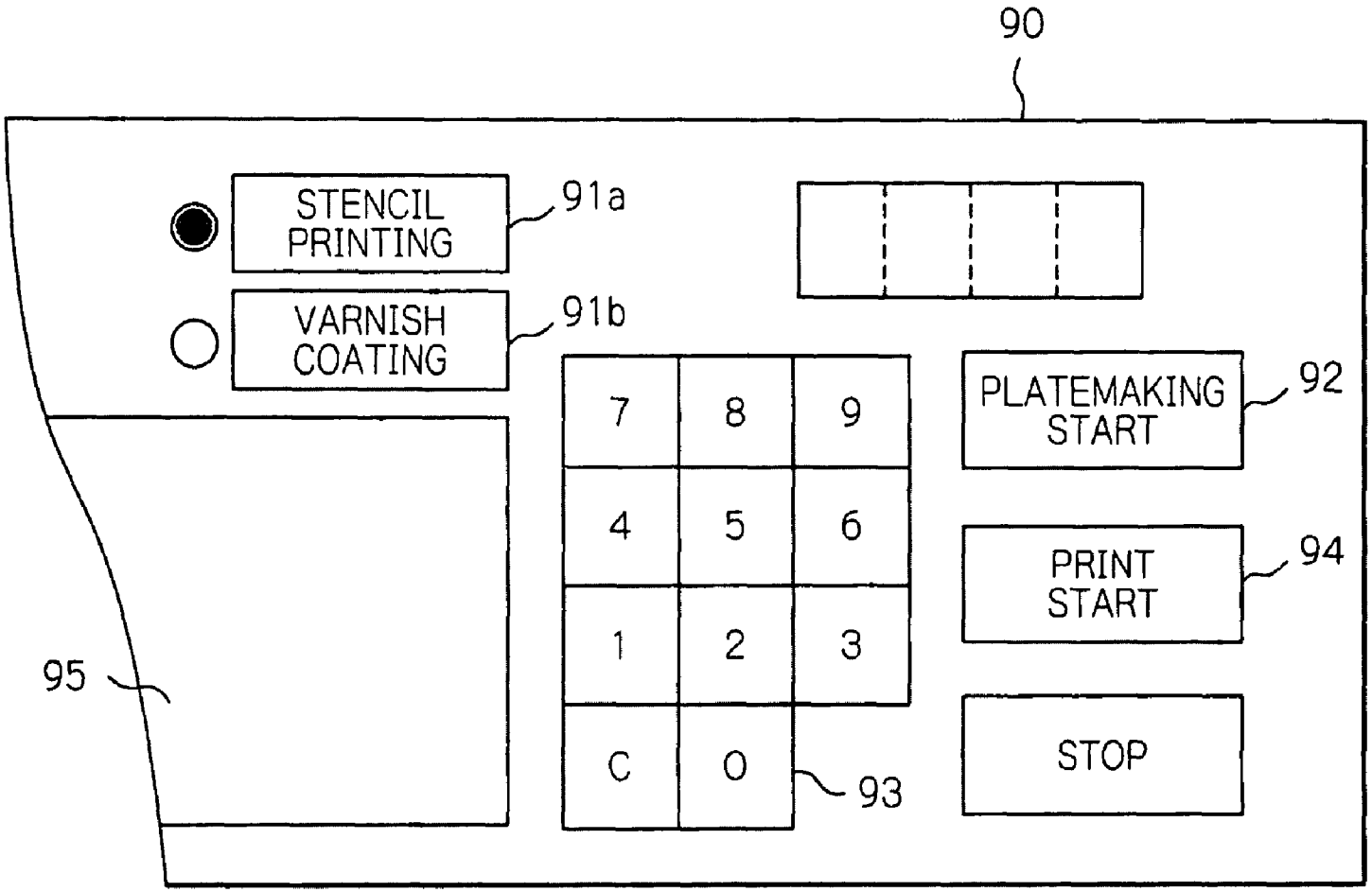
FIG. 4 is a plan-view diagram illustrating the configuration of a relevant portion of an operation panel.

When in step S3 the unit discrimination sensor 37 does not detect that the drum unit 40 is mounted, the liquid crystal display 95 of the control panel 90 of FIG. 4 displays a drum unit mounting warning to the effect of "please mount drum unit" (step S12).

On the other hand, when in step S13 the unit discrimination sensor 37 does not detect that varnish coating unit 20 is mounted, the liquid crystal display 95 of the control panel 90 displays a varnish coating unit mounting warning to the effect of "please mount varnish coating unit" (step S23). The warnings in step S12 and step S23 may also be carried out concomitantly with blinking of the LEDs or the like accompanied with the sound of a buzzer or the like, not shown.

In step S2 through step S5, and step S13 through step S22, the controller 68 functions as an eighth control means. Specifically, when the unit discrimination sensor 37 detects that the drum unit 40 is mounted, and start is set by way of the platemaking start key 92 (start setting means), the controller 68 permits the plate feeding driving circuit 67 to execute a plate perforation step in step S4 and a plate feeding and wrapping step in step S5 (platemaking operation and plate feeding operation). When the unit discrimination sensor 37 detects that the varnish coating unit 20 is mounted, the controller 68 prohibits the plate feeding driving circuit 67 from executing a plate perforation step in step S4 and a plate feeding and wrapping step in step S5 (platemaking operation and plate feeding operation, even when start is accidentally set by way of the start key 92 (start setting means).

The below well-known series of stencil printing operations are executed thus when the stencil printing mode is selected and set, namely when the platemaking start key 92 is pressed and the unit discrimination sensor 37 detects that the drum unit 40 is mounted.

Specifically, an original is set on an original reading device, not shown, and paper 2 is appropriately replenished in the paper-feeding tray 1, as preparations for the stencil printing operation. Then, upon pressing the platemaking start key 92, a plate discharge step (plate discharge operation) is carried out first. That is, a used master wrapped around the plate cylinder 70*a* in FIG. 1 is released from the plate cylinder 70*a* by the plate discharging device 66, is transported and stored in a plate-discharging box, not shown, and is compressed by a compression board, not shown. Simultaneously with the plate discharge step, the original reading device reads optically the original, by way of a CCD or the like, and converts the original into electric signals. In accordance with the image information of the original, multiple heat generators of a thermal belt (not shown), as a platemaking means in the platemaking device 65, are position-selectively driven to generate heat, as a result of which the image is perforated on the master 71. The master 71 is then transported downstream, in the master transport, direction, through the rotation of a platen roller (not shown) as a master transport means, a pair of tension rollers (not shown), the upper plate feeding roller 73 and the lower plate feeding roller 74 (step S4).

Next, the master clamper 72 is closed by an opening and closing device not shown, when the controller 68 judges that the leading end of the prepared master 71 has reached the master clamper 72 of FIG. 7, expanded into a plate feeding standby state, on the basis of, for instance, the number of steps of a stepping motor, not shown, that rotationally drives the platen roller and so forth. The leading end of the prepared master 71 becomes clamped as a result by the master clamper 72. When the controller 68 judges that perforation of one master 71 is over, on the basis of, for instance, the number of steps of a stepping motor, the trailing end of the prepared master 71 is cut by a cutting device, not shown, and the rotation of the platen roller, the pair of tension rollers, the upper plate feeding roller 73 and the lower plate feeding roller 74, is discontinued. The printing drum 70 is then rotationally driven in the clockwise direction of FIG. 7 through start and rotation initiation of the main motor, as a result of which the prepared master 71 becomes wrapped around the plate cylinder 70*a* (step S6).

A plate printing step is carried out next in which the above-described paper feeding device transports one sheet of paper 2, and in which ink seeping through the inner peripheral face of the plate cylinder 70*a* is supplied to the prepared master 71 on the outer peripheral face of the plate cylinder 70*a*, whereupon the ink becomes closely adhered, on account of the inventions adherence, to the outer peripheral face of the plate cylinder 70*a* (step S6).

Once the plate printing step is over, the user checks the printed image position and the image quality of the plate-fixing printed product. Based on the check results, appropriate test runs are printed, after which the user inputs, via the numerical keypad 93, the number of required normal printed sheets, and presses the print start key 94, whereupon the printing drum 70 is rotationally driven. The pickup roller 3 and the reverse roller 4 of the sheet-supply device are also rotationally driven, thereby initiating the transport of the paper 2, followed by the above-described stencil printing step and paper output step. All the steps of the stencil printing operation are over once the set number of sheets of paper 2 is printed (step S7 to step S11).

Next, when the varnish coating mode is selected, in step S13, and the unit discrimination sensor 37 detects, in step S14, that the varnish coating unit 20 is mounted, the below-described particular control operation of the present embodiment is executed.

Figure 5:
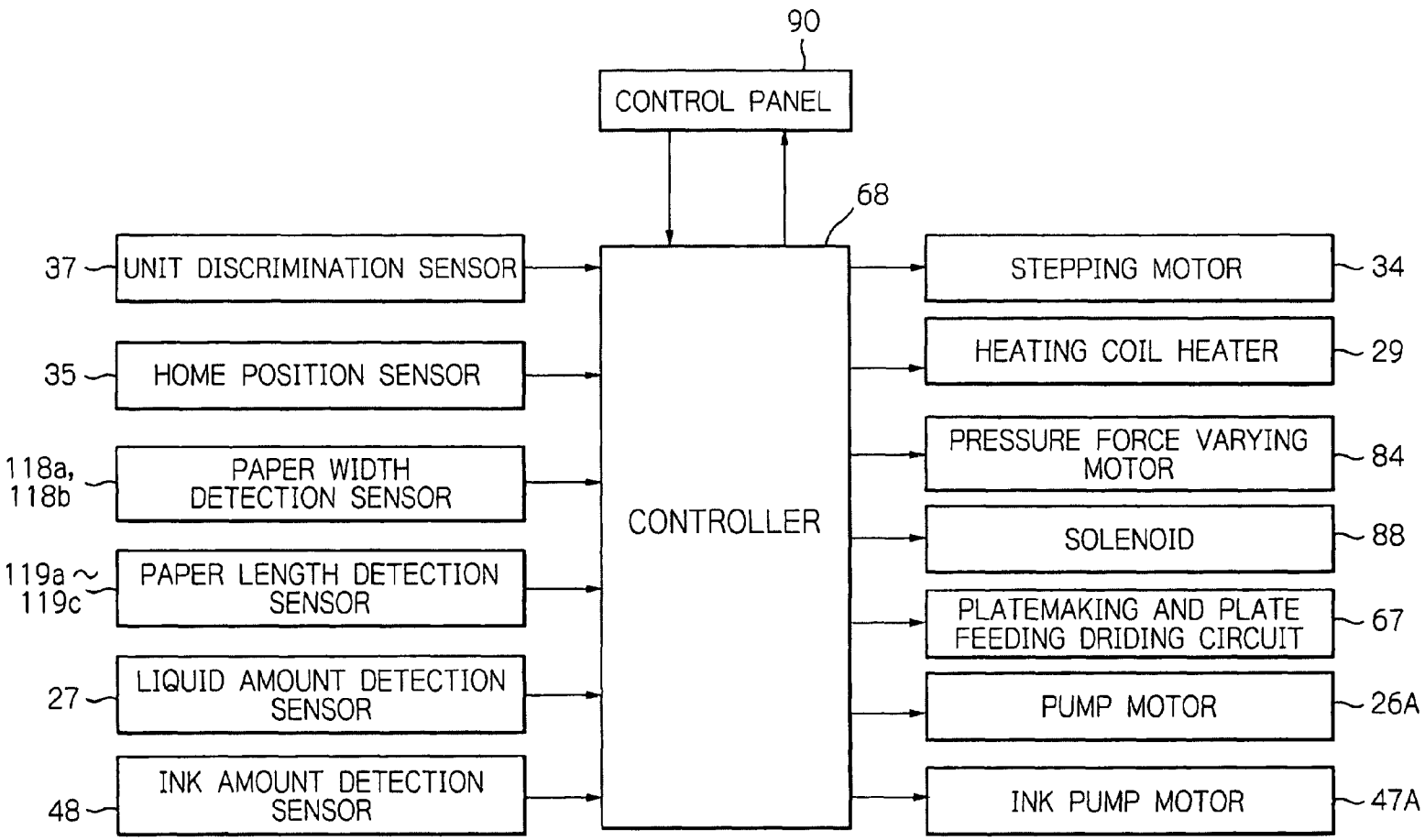
FIG. 5 is a block diagram illustrating the configuration of a control system of a relevant portion of the varnish coating device in the stencil printing apparatus of FIG. 1.

Firstly, in step S15, the paper width detection sensors 118*a*, 118*b* and the paper length detection sensors 119*a* through 119*c* in FIG. 1 and FIG. 5 detect the paper size of the paper 2 stacked/set on the paper-feeding tray 1. Next, a partition plate movement adjustment is carried out, for optimizing the coating range width of the varnish liquid, by moving the partition plates 32*a*, 32*b* illustrated in FIGS. 3A and 3B, in the varnish coating unit 20, in accordance with the paper size (step S16).

Herein, the controller 68 functions as second control means for controlling the stepping motor 34 of the supply range varying means illustrated in FIGS. 3A and 3B in such a way so as to modify the varnish coating area length (varnish liquid supply length as a coating liquid supply length), in accordance with the paper width direction size of the printed paper 2 as detected by the paper width detection sensors 118*a*, 118*b* (sheet width size detection means).

Specifically, once the width dimension M of the paper 2 is detected, the controller 68 computes and determines a varnish coating area length H in accordance with the width dimension M of the paper 2, leaving a predetermined margin h1 from both left and right ends of the paper 2, as in FIGS. 6A and 6B. The controller 68 adjusts the spacing between the partition plates 32*a*, 32*b* to the varnish coating area length H, by driving the stepping motor 34, to rotate thereby the screw 33. That is, the controller 68 adjusts the spacing between the partition plates 32*a*, 32*b* in such a manner that $H=M-2\times h1$. Needless to say, the required data for this calculation expression is stored beforehand in the ROM of the controller 68 (likewise hereinafter).

The varnish coating area length H may also be set on the basis of an instruction/setting from the operation panel 90 illustrated in FIG. 4. That is, a numerical value of the varnish coating area length H is inputted/set via the numerical keypad 93 of the control panel 90. Herein, the controller 68 functions as a first control means for controlling the stepping motor 34 of the supply range varying means illustrated in FIGS. 3A and 3B, in such a way that the varnish coating area length becomes the varnish coating area length set by the numerical keypad 93 as a setting means for setting the varnish coating area length (varnish liquid supply length as a coating liquid supply length) of the supply range varying means.

The controller 68 drives the stepping motor 34 to rotate the lead screw 33 and adjust thereby the spacing of the partition plates 32*a*, 32*b* so as to obtain the numerical width dimensions inputted via the numerical keypad 93.

As illustrated in FIG. 6B, a range L, in which a margin h2 is set on the front and rear of the transport direction length N of the paper 2, constitutes a varnish coating area. That is, the controller 68 controls and drives the solenoid 88, as the contact-pressure range varying means illustrated in FIG. 8B, in such a manner that $L=N-2\times h2$.

Upon detection that the varnish coating unit 20 is mounted, the controller 68 functions as a fifth control means for controlling the solenoid 88, as a pressure range varying means, in such a manner so as to change the range of pressure exerted by the press roller 9 onto the printed paper 2 in accordance with the paper transport direction size detected by the paper length detection sensors 119*a* through 119*c* (sheet transport direction size detection means) (step S17).

The varnish coating area L may also be set on the basis of an instruction/setting from the operation panel 90 illustrated in FIG. 4. That is, a numerical value of the varnish coating area L (sheet transport direction size) is inputted/set via the numerical keypad 93 of the control panel 90. Herein, the controller 68 functions as a sixth control means for controlling the solenoid 88 of the contact-pressure range varying means, in such a way so that the varnish coating area is changed in accordance with the paper transport direction size set by the numerical keypad 93 as a setting means for setting the varnish coating area L (sheet transport direction size) of the supply range varying means.

Figure 10:
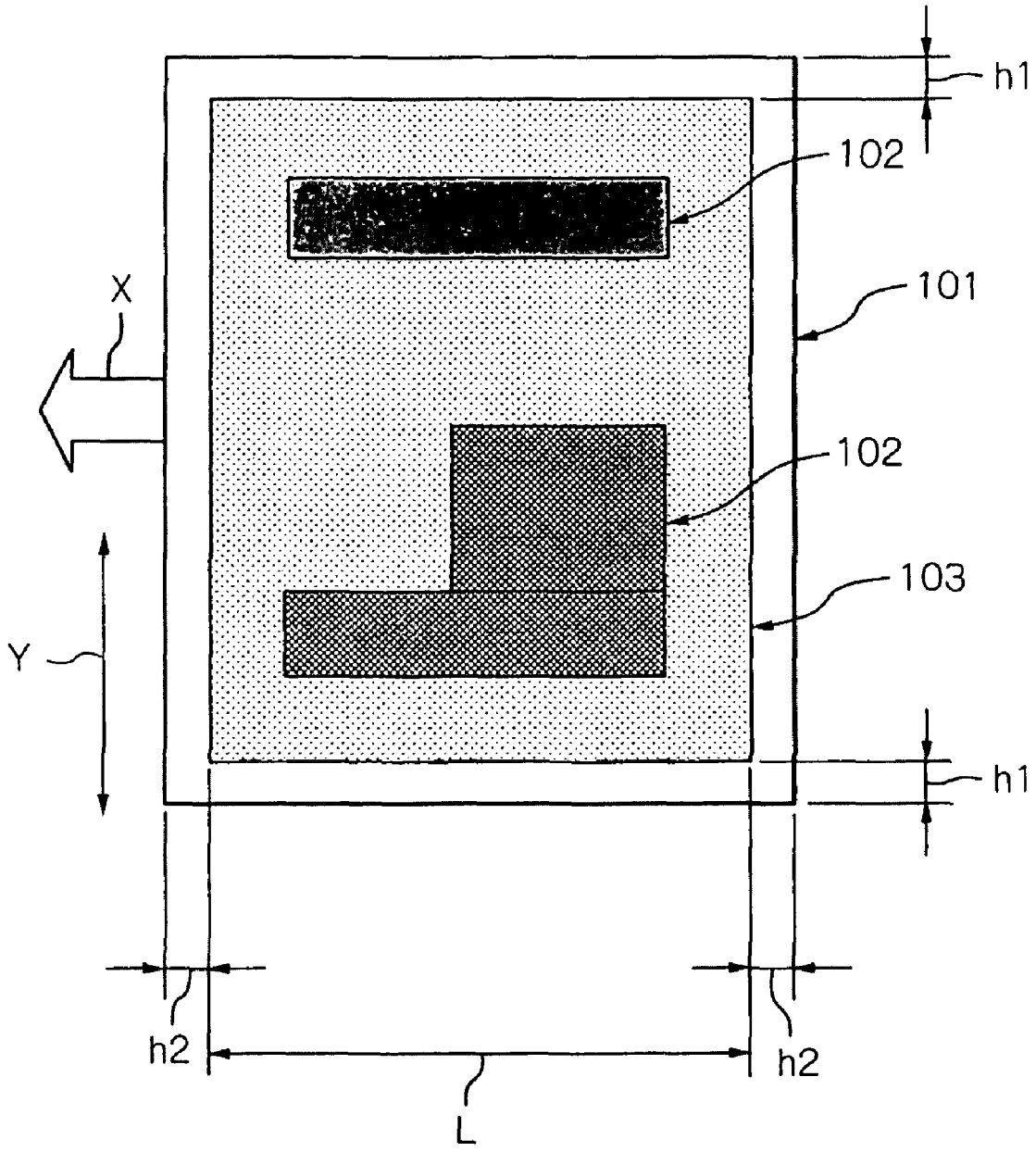
FIG. 10 is a diagram illustrating an example of a printed product having been coated with varnish by the varnish coating unit.

A supplementary explanation follows herein, with reference to FIG. 10, on the manner for setting the pressure-on range. FIG. 10 illustrates an example of a printed product having been coated with varnish by the varnish coating device 39. In the figure, the reference numeral 101 denotes a printed product (an example of the printed paper 2). The printed product has already formed thereon an image 102 on plural locations, by means such as digital stencil printing, or by using the stencil printing apparatus 50, the relevant portions of which are illustrated in FIG. 7. This printing is carried out by mounting the drum unit 40 illustrated in FIG. 7, for ordinary printing, on the printing apparatus main body 100, as described above.

Next, the process moves onto step S18. When a required number of varnish coat sheets is registered/inputted via the numerical keypad 93, and the print start key 94 is pressed, similarly as explained with reference to FIG. 1 and FIG. 2, the coating roller 8 is rotationally driven, and the pickup roller 3 and the reverse roller 4 of the sheet-supply device are also rotationally driven, thereby initiating the feeding and transport of the printed paper 2, followed by varnish coating of the surface thereof (step S19, step S20).

When the unit discrimination sensor 37 detects that the varnish coating unit 20 is mounted, the controller 68 functions as third control means for controlling a power supply that supplies power to the heating coil heater 29 of the air blowing fan 11 in such a manner that the air blown between the coating roller 8 and the printed paper 2 that is fed after varnish coating is turned into hot blown air by turning the heating coil heater 29 on.

By blowing thus hot air onto the varnish on the surface of the printed paper 2 (printed product), the viscosity of the varnish is lowered, and the surface thereof is leveled by air pressure. The varnish surface can become smooth and sufficiently glossy as a result.

When the unit discrimination sensor 37 detects that the varnish coating unit 20 is mounted, the controller 68 functions, in addition to the above control, as a fourth control means for controlling the solenoid 88 of the pressing force varying means in such a manner that the pressing force exerted by the press roller 9 is comparatively smaller than when the drum unit 40 is mounted. This is done in the same way as explained with reference to FIG. 8B.

The varnish coating step is explained next with reference to FIG. 10. The printed product 101 is transported and fed once more while the surface thereof is coated now with varnish. The varnish coating range herein is a varnish coating area 103 inward of the margins h1, h2 from the contour of the printed product 101. In the figure, when the paper transport direction X points left, the varnish coating area 103 is the range within which the printed product 101 or the printed paper 2 is pressed against the coating roller 8 when pressure by the press roller 9 is turned on.

Within the coating area 103, a predetermined thickness of varnish is printed/coated onto a print image, which imparts the print image with glossiness, while enhancing the durability, wetting resistance and scratch resistance (abrasion resistance) of the print image. The visual quality or the printed product improves thereby, which adds value to the product.

Next, the varnish-coated printed paper 2 (printed product), which is released from the coating roller 8 by the air separation pawl 10 and the air blowing fan 11, is transported to the UV-radiating device 51 by the paper output transport device 12, and is further transported by the printed product transport device 52. The varnish-coated printed paper 2 is irradiated with direct UV rays from the UV-ray lamps 59 and with UV rays reflected by the reflective plate 60. The varnish on the varnish-coated surface of the printed product becomes cured and fixed thereby, after which the paper is stacked, neatly aligned, on the paper output tray 62. All the operation steps by the varnish coating device 39 terminate once the set number of sheets of the printed paper 2 (printed product) are coated with varnish (step S20 to step S22). From the above it follows that the constitution, action, operation and so forth of the present embodiment afford the effects set forth in the section on the effect of the invention.

As described above, the present invention allows realizing and providing a coating device and a coating unit in a novel stencil printing apparatus that solves the above-described problems of conventional art. The effects afforded by the present invention are enumerated below.

(1) A coating unit, for coating a predetermined area of the surface of a fed printed sheet (hereinafter referred to also as sheet-like "printed product" in the present section) with a given thickness of a viscous coating liquid, is configured to be detachably mounted on a printing apparatus main body in place of a printing drum unit. As a result, the printed product can be imparted a stylish feel, as well as storability and abrasion resistance, by coating a predetermined range (predetermined area) of the printed product with a uniform thickness of a viscous coating liquid (for instance, a UV-curable varnish liquid), in an inexpensive, simple and convenient way, employing an ordinarily used stencil printing apparatus that anyone can operate.

(2) The coating unit comprises a coating member for coating the surface of a printed sheet with a coating liquid; a supply device for forming a liquid pool, where the coating liquid accumulates temporarily, on the coating member, and for supplying a predetermined thickness of the coating liquid to the surface of the coating member; a holding member for holding a coating liquid storage container that contains the coating liquid; and a pump device for feeding the coating liquid from the coating liquid storage container to the liquid pool. Accordingly, the technology of the printing portion of a stencil printing apparatus can be effectively appropriated, using a simple structure and relying on a compact and inexpensive configuration. The amount of coating liquid, moreover, is maintained automatically, which results in an easier operation.

(3) In the above configuration, a first control means controls a supply range varying means in such a way so as to achieve a coating liquid supply length set by a setting means. As a result, the coating liquid (for instance, a UV-curable varnish liquid) can be reliably applied within only an appropriate range, while problems caused by overflow of excessive coating liquid can be prevented, thereby allowing the coating liquid to be applied in a required amount over a required area.

(4) In the above configuration, a second control means controls the supply range varying means in such a way so as to change the coating liquid supply length in accordance with the sheet width direction size of a printed sheet as detected by a sheet width size detection means. As a result, coating liquid can be appropriately applied automatically over a predetermined area in accordance with the sheet width direction size, and coating liquid overflow can be prevented by way of a simple operation, without the need for an operator or user (hereinafter "user") to instruct/set the coating area of the coating liquid (for instance, a UV-curable varnish liquid) every time.

(5) In the above configuration, a third control means controls an air-blast release means in such a way so as to turn, into hot blown air, air that is blown between the coating member and the fed printed sheet after coating, when a unit discrimination means detects that the coating unit is mounted. As a result, the viscosity of the coated coating liquid (for instance, a UV-curable varnish liquid) decreases on account of the higher temperature. This affords a surface leveling effect that increases surface smoothness and allows imparting a glossy finish to the printed product.

(6) In the above configuration, a fourth control means controls a pressing force varying means in such a manner that, when the unit discrimination means detects that the coating unit is mounted, a pressing force is smaller than when the printing drum unit is mounted. As a result, the pressing force exerted is the minimum required for coating the coating liquid (for instance, a UV-curable varnish liquid). In addition to reducing noise, this allows preventing the problem that arises when the printed product wraps onto the coating member on account of excessive pressing force, and the problem of coating liquid overflow at both sides of the printed product on account of excessive pressing force.

(7) A fifth control means changes the pressure range of a pressing member in the sheet transport direction in accordance with a sheet transport direction size of the printed sheet as detected by a sheet transport direction size detection means, when the unit discrimination means detects that the coating unit is mounted. As a result, coating liquid can be appropriately applied automatically onto a predetermined area in accordance with the sheet transport direction size of the printed sheet, without the need for the user to instruct/set the coating area of the coating liquid (for instance, a UV-curable varnish liquid) every time, while preventing the problem of contamination of the pressing member caused by supply of coating liquid to portions other than the sheet transport direction size of the printed sheet. Also, coating liquid overflow can be prevented by way of a simple operation.

(8) A sixth control means changes the pressure range of the pressing member in the sheet transport direction in accordance with the sheet transport direction size of the printed sheet as set by a sheet transport direction size setting means, when the unit discrimination sensor detects that the coating unit is mounted. As a result, coating liquid can be appropriately applied automatically onto a predetermined area in accordance with the coating area of the coating liquid (for instance, UV-curable varnish liquid) instructed/set by the user, while preventing the problem of contamination of the pressing member caused by supply of coating liquid to portions other than the sheet transport direction size of the printed sheet. Also, coating liquid overflow can be prevented by way of a simple operation.

(9) A seventh control means performs control in such a way so as to permit inputs and operations when a stencil printing mode is selected and set by a mode selecting and setting means and the unit type detection means detects that the printing drum unit is mounted, and so as to permit inputs and operations when a coating liquid coating mode is selected and set by the mode selecting and setting means and the unit type detection means detects that the coating unit is mounted. As a result, this allows proactively preventing problems derived from a mismatch between the mounted unit and the instructed and selected/set mode, and allows issuing a warning to the user when the wrong unit is mounted.

(10) An eighth control means permits execution of a platemaking operation and a plate feeding operation when the unit type detection means detects that the printing drum unit is mounted, and start is set by a start setting means, and disables (prohibits) execution of a platemaking operation and a plate feeding operation when the unit type detection means detects that the coating unit is mounted, even when start is set by the start setting means. This allows preventing problems from occurring in a platemaking section, and/or wasting of a master in a platemaking operation, as a result of accidental pressing of the start setting means, even with the coating unit being mounted at that time.

(11) The above configuration allows curing and fixing instantly, through irradiation of UV rays, the UV-curable varnish liquid applied onto the surface of the printed product, so that the printed product, imparted thereby with a stylish feel, can be immediately manipulated, without further modification, in a subsequent process.

(12) In the above configuration, the coating unit that is mounted in place of the printing drum unit applies a given thickness of viscous coating liquid over a predetermined area of the surface of the printed sheet. A coating unit can be realized and provided as a result wherein the printed product can be imparted a stylish feel, as well as storability and abrasion resistance, by coating a predetermined range (predetermined area) of the printed product with a uniform thickness of a viscous coating liquid (for instance, a UV-curable varnish liquid), in an inexpensive, simple and convenient way, employing an ordinarily used stencil printing apparatus that anyone can operate.

(13) A coating unit can be realized and provided wherein the coating unit comprises a coating member for coating the surface of a printed sheet with a coating liquid; a supply device for forming a liquid pool, where the coating liquid accumulates temporarily, on the coating member, and for supplying a predetermined thickness of the coating liquid to the surface of the coating member; a holding member for holding a coating liquid storage container that contains the coating liquid; and a pump device for feeding the coating liquid from the coating liquid storage container to the liquid pool. Accordingly, the technology of the printing portion of a stencil printing apparatus can be effectively appropriated, using a simple structure and relying on a compact and inexpensive configuration. The amount of coating liquid, moreover, is maintained automatically, which results in an easier operation.

Various modifications will become possible for those skilled in the art after receiving the teachings of the present disclosure without departing from the scope thereof.

What is claimed is:

1. A coating device in a stencil printing apparatus in which a printing drum unit whose outer peripheral face is wrapped with a prepared master can be detachably mounted on a printing apparatus main body, comprising:

a coating unit that can be detachably mounted on said printing apparatus main body, in place of said printing drum unit, to form a coating in a given thickness of a viscous coating liquid onto a predetermined area of a surface of a printed sheet that is fed, wherein said coating unit comprises:

a coating member to coat the surface of a printed sheet with a coating liquid, a supply device to form a liquid pool, where the coating liquid accumulates temporarily, on said coating member, and for supplying said coating liquid to form a coating in a predetermined thickness to the surface of said coating member, a holding member to hold a coating liquid storage container that contains said coating liquid, and a pump device to feed said coating liquid from said coating liquid storage container to said liquid pool, wherein said supply device comprises:

supply range varying means for varying a coating liquid supply length in a sheet width direction that is perpendicular to a sheet transport direction;

setting means for setting said coating liquid supply length for said supply range varying means; and first control means for controlling said supply range varying means in such a manner that a coating liquid supply length becomes said coating liquid supply length set by said setting means.

2. A coating device in a stencil printing apparatus in which a printing drum unit whose outer peripheral face is wrapped with a prepared master can be detachably mounted on a printing apparatus main body, comprising:

a coating unit that can be detachably mounted on said printing apparatus main body, in place of said printing drum unit, to form a coating in a given thickness of a viscous coating liquid onto a predetermined area of a surface of a printed sheet that is fed, wherein said coating unit comprises:

a coating member to coat the surface of a printed sheet with a coating liquid, a supply device to form a liquid pool, where the coating liquid accumulates temporarily, on said coating member, and for supplying said coating liquid to form a coating in a predetermined thickness to the surface of said coating member, a holding member to hold a coating liquid storage container that contains said coating liquid, and a pump device to feed said coating liquid from said coating liquid storage container to said liquid pool, wherein said supply device comprises:

supply range varying means for varying a coating liquid supply length in a sheet width direction that is perpendicular to a sheet transport direction;

sheet width size detection means for detecting a sheet width direction size of a printed sheet; and second control means for controlling said supply range varying means in such a manner that said coating liquid supply length is varied in accordance with said sheet width direction size detected by said sheet width size detection means.

3. A coating device in a stencil printing apparatus in which a printing drum unit whose outer peripheral face is wrapped with a prepared master can be detachably mounted on a printing apparatus main body, comprising:

a coating unit that can be detachably mounted on said printing apparatus main body, in place of said printing drum unit, to form a coating in a given thickness of a viscous coating liquid onto a predetermined area of a surface of a printed sheet that is fed, wherein said coating unit comprises:

a coating member to coat the surface of a printed sheet with a coating liquid, a supply device to form a liquid pool, where the coating liquid accumulates temporarily, on said coating member, and for supplying said coating liquid to form a coating in a predetermined thickness to the surface of said coating member, a holding member to hold a coating liquid storage container that contains said coating liquid, and a pump device to feed said coating liquid from said coating liquid storage container to said liquid pool;

air-blast release means, disposed in the vicinity of said coating member, for turning, into hot blown air, air that is blown for releasing a printed sheet from said coating member, after coating of said coating liquid onto the printed sheet;

unit type detection means for detecting whether either said printing drum unit or said coating unit is mounted to said printing apparatus main body; and third control means for, when said unit type detection means detects that said coating unit is mounted, controlling said air-blast release means so as to turn, into hot blown air, air that is blown between said coating member and said fed printed sheet, after coating said coating liquid.

4. A coating device in a stencil printing apparatus in which a printing drum unit whose outer peripheral face is wrapped with a prepared master can be detachably mounted on a printing apparatus main body, comprising:

a coating unit that can be detachably mounted on said printing apparatus main body, in place of said printing drum unit, to form a coating in a given thickness of a viscous coating liquid onto a predetermined area of a surface of a printed sheet that is fed, wherein said coating unit comprises:

a coating member to coat the surface of a printed sheet with a coating liquid, a supply device to form a liquid pool, where the coating liquid accumulates temporarily, on said coating member, and for supplying said coating liquid to form a coating in a predetermined thickness to the surface of said coating member, a holding member to hold a coating liquid storage container that contains said coating liquid, and a pump device to feed said coating liquid from said coating liquid storage container to said liquid pool;

unit type detection means for detecting whether either said printing drum unit or said coating unit is mounted to said printing apparatus main body;

a pressing member to press a printed sheet against said coating member;

pressing force varying means for modifying the pressing force with which said pressing member presses a printed sheet against said coating member; and fourth control means for, when said unit type detection means detects that said coating unit is mounted, controlling said pressing force varying means in such a manner that said pressing force is smaller than when said printing drum unit is mounted.

5. A coating device in a stencil printing apparatus in which a printing drum unit whose outer peripheral face is wrapped with a prepared master can be detachably mounted on a printing apparatus main body, comprising:

a coating unit that can be detachably mounted on said printing apparatus main body, in place of said printing drum unit, to form a coating in a given thickness of a viscous coating liquid onto a predetermined area of a surface of a printed sheet that is fed, wherein said coating unit comprises:

a coating member to coat the surface of a printed sheet with a coating liquid, a supply device to form a liquid pool, where the coating liquid accumulates temporarily, on said coating member, and for supplying said coating liquid to form a coating in a predetermined thickness to the surface of said coating member, a holding member to hold a coating liquid storage container that contains said coating liquid, and a pump device to feed said coating liquid from said coating liquid storage container to said liquid pool;

unit type detection means for detecting whether either said printing drum unit or said coating unit is mounted to said printing apparatus main body;

sheet transport direction size detection means for detecting a sheet transport direction size of a printed sheet;

a pressing member to press a printed sheet against said coating member;

pressure range varying means for varying the pressure range in said sheet transport direction when said pressing member presses a printed sheet against said coating member; and fifth control means for, when said unit type detection means detects that said coating unit is mounted, controlling said pressure range varying means so as to vary said pressure range in accordance with said sheet transport direction size detected by said sheet transport direction size detection means.

6. A coating device in a stencil printing apparatus in which a printing drum unit whose outer peripheral face is wrapped with a prepared master can be detachably mounted on a printing apparatus main body, comprising:

a coating unit that can be detachably mounted on said printing apparatus main body, in place of said printing drum unit, to form a coating in a given thickness of a viscous coating liquid onto a predetermined area of a surface of a printed sheet that is fed, wherein said coating unit comprises:

a coating member to coat the surface of a printed sheet with a coating liquid, a supply device to form a liquid pool, where the coating liquid accumulates temporarily, on said coating member, and for supplying said coating liquid to form a coating in a predetermined thickness to the surface of said coating member, a holding member to hold a coating liquid storage container that contains said coating liquid, and a pump device to feed said coating liquid from said coating liquid storage container to said liquid pool;

unit type detection means for detecting whether either said printing drum unit or said coating unit is mounted to said printing apparatus main body;

sheet transport direction size setting means for setting a sheet transport direction size of a printed sheet;

a pressing member to press a printed sheet against said coating member;

pressure range varying means for varying the pressure range in said sheet transport direction when said pressing member presses a printed sheet against said coating member; and sixth control means for, when said unit type detection means detects that said coating unit is mounted, controlling said pressure range varying means so as to vary said pressure range in accordance with said sheet transport direction size set by said sheet transport direction size setting means.

7. A coating device in a stencil printing apparatus in which a printing drum unit whose outer peripheral face is wrapped with a prepared master can be detachably mounted on a printing apparatus main body, comprising:

a coating unit that can be detachably mounted on said printing apparatus main body, in place of said printing drum unit, to form a coating in a given thickness of a viscous coating liquid onto a predetermined area of a surface of a printed sheet that is fed;

mode selecting and setting means for selecting and setting either a stencil printing mode, in which printing is carried out by mounting said printing drum unit on said printing apparatus main body, or a coating liquid coating mode, in which a coating liquid is applied by mounting said coating unit on said printing apparatus main body;

unit type detection means for detecting whether either said printing drum unit or said coating unit is mounted to said printing apparatus main body; and seventh control means for performing control so as to permit inputs and operations when said stencil printing mode is selected and set by said mode selecting and setting means and said unit type detection means detects that said printing drum unit is mounted, and so as to permit inputs and operations when said coating liquid coating mode is selected and set by said mode selecting and setting means and said unit type detection means detects that said coating unit is mounted.

8. A coating device in a stencil printing apparatus in which a printing drum unit whose outer peripheral face is wrapped with a prepared master can be detachably mounted on a printing apparatus main body, comprising:

a coating unit that can be detachably mounted on said printing apparatus main body, in place of said printing drum unit, to form a coating in a given thickness of a viscous coating liquid onto a predetermined area of a surface of a printed sheet that is fed;

unit type detection means for detecting whether either said printing drum unit or said coating unit is mounted on a coating device main body in said stencil printing apparatus;

start setting means for setting the start of a platemaking operation in which a master is prepared, and a plate feeding operation in which a prepared master is fed to said printing drum unit; and eighth control means for allowing execution of said platemaking operation and said plate feeding operation when said unit type detection means detects that said printing drum unit is mounted, and start is set by said start setting means, and for disabling execution of said platemaking operation and said plate feeding operation when said unit type detection means detects that said coating unit is mounted, even when start is set by said start setting means.

* * * * *